US012325995B1

(12) United States Patent
Herron, III

(10) Patent No.: US 12,325,995 B1
(45) **Date of Patent: *Jun. 10, 2025**

(54) HIGH STRENGTH, LOW DENSITY COLUMNAR STRUSTURE

(71) Applicant: HERRON INTELLECTUAL PROPERTY HOLDINGS, LLC, Gulf Breeze, FL (US)

(72) Inventor: Warren Herron, III, Gulf Breeze, FL (US)

(73) Assignee: HERRON INTELLECTUAL PROPERTY HOLDINGS, LLC, Gulf Breeze, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/234,179

(22) Filed: Aug. 15, 2023

Related U.S. Application Data

(63) Continuation of application No. 17/314,305, filed on May 7, 2021, now Pat. No. 11,732,477, which is a continuation of application No. 16/728,233, filed on Dec. 27, 2019, now Pat. No. 11,002,013, which is a continuation of application No. 16/100,480, filed on Aug. 10, 2018, now Pat. No. 10,519,658.

(51) Int. Cl.
*E04C 3/32* (2006.01)
*E04C 3/34* (2006.01)
*E04C 3/36* (2006.01)

(52) U.S. Cl.
CPC ..... *E04C 3/32* (2013.01); *E04C 3/34* (2013.01); *E04C 3/36* (2013.01)

(58) Field of Classification Search
CPC ..... E04C 3/32; E04C 3/34; E04C 3/36
USPC ..... 52/844; 446/120–128
See application file for complete search history.

(56) References Cited

U.S. PATENT DOCUMENTS 1,090,171 A * 3/1914 Schisler ..... E04C 3/04 52/844
1,804,320 A * 5/1931 Cross ..... E04C 3/36 52/249
3,413,775 A * 12/1968 Katz ..... E04F 13/18 52/834
3,596,391 A * 8/1971 Knight, Jr. ..... A63H 33/04 40/738

(Continued)

*Primary Examiner* — James M Ference
(74) *Attorney, Agent, or Firm* — ROY KIESEL FORD DOODY & NORTH APLC

(57) ABSTRACT

A high strength, low density modular columnar structure. In the preferred embodiment, each module is a prism or cuboid having three or four vertical rectangular sides which meet in the module corners. The module ends perpendicular to the sides are the module faces. At least one face has a brace panel. The brace panels and the face are preferably the same shape, but off-set. A plurality of preferably triangular brace arms extends to the module corners. Each brace panel is preferably provided with a centrally located aperture. The lower face of each module is preferably provided with a lip, while the upper face is configured to receive the lip. A cylindrical column extends vertically through the center of each module, and a plurality of struts extends radially from each column. A stack of modules may be secured with a bolt run through the module apertures, an adhesive, or simply gravity.

21 Claims, 29 Drawing Sheets

(56) References Cited

U.S. PATENT DOCUMENTS 4,467,584 A * 8/1984 Crites ..... E04F 13/0733 52/489.1
4,606,167 A * 8/1986 Thorne ..... E04C 3/30 52/746.1
4,686,807 A * 8/1987 Newsome ..... F24B 1/18 126/307 R
4,912,901 A * 4/1990 Jerry ..... E04F 13/0733 52/311.1
4,958,807 A * 9/1990 Wylie ..... E04F 11/181 403/191
5,022,885 A * 6/1991 Lyman ..... A63H 33/10 446/120
5,335,471 A * 8/1994 Kupiec ..... G02B 6/0096 52/28
5,361,977 A * 11/1994 Ogrodnick, Jr. ... A47G 29/1216 52/301
5,761,861 A * 6/1998 Brackett ..... E04H 12/28 52/316
5,848,927 A * 12/1998 Frederiksen ..... A63H 33/086 446/124
5,881,528 A * 3/1999 Grewe ..... E04F 13/0733 52/834
5,934,035 A * 8/1999 Rasmussen ..... E04C 1/395 52/300
5,956,920 A * 9/1999 Davis ..... E04F 11/1842 52/844
6,009,683 A * 1/2000 Grewe ..... E04C 3/30 52/301
6,065,268 A * 5/2000 Gump ..... E04F 15/0247 52/301
6,098,353 A * 8/2000 Stanfield ..... E01F 9/685 52/848
6,148,585 A * 11/2000 Baker ..... E04C 3/30 52/489.1
6,305,670 B1 * 10/2001 Ward ..... E04F 11/1842 256/65.05
6,622,451 B1 * 9/2003 Ellis ..... B44C 3/12 428/36.9
6,643,982 B1 * 11/2003 Lapp ..... E04C 3/36 52/127.2
6,648,714 B1 * 11/2003 Kuo ..... A63H 33/065 446/85
7,021,017 B2 * 4/2006 Herron ..... E04C 2/20 428/116
7,455,282 B2 * 11/2008 Platt ..... E04F 11/1814 256/65.01
7,762,041 B1 * 7/2010 Wawrzeniak ..... E04C 3/32 52/848
7,866,120 B2 * 1/2011 Prenn ..... E04F 11/1814 52/844
7,908,821 B2 * 3/2011 Prenn ..... E04F 11/1814 52/844
7,992,362 B2 * 8/2011 Petta ..... E04C 3/30 52/855
8,015,775 B2 * 9/2011 McMullen ..... E04C 3/36 52/170
8,033,080 B2 * 10/2011 Revenus ..... F16P 1/00 52/645
8,074,424 B2 * 12/2011 Waters ..... E04C 3/30 52/287.1
8,104,249 B2 * 1/2012 Griffiths ..... F16B 23/0069 138/155
8,186,129 B2 * 5/2012 Noirot ..... B65D 59/06 52/301
8,382,548 B2 * 2/2013 Maggiore ..... A63H 33/04 446/124
8,443,576 B2 * 5/2013 Petta ..... E04C 3/30 52/843
8,464,482 B2 * 6/2013 Raynor ..... E04C 3/34 52/169.9
8,609,226 B2 * 12/2013 Herron, III ..... E04C 2/326 52/630
8,839,593 B2 * 9/2014 Barrett ..... E04H 12/12 52/404.1
9,140,016 B2 * 9/2015 Habodasz ..... E04F 13/185
9,145,683 B2 * 9/2015 Matys ..... E04C 3/34
10,519,658 B1 * 12/2019 Herron, III ..... E04C 3/34
11,002,013 B1 * 5/2021 Herron, III ..... E04C 3/34
2003/0106279 A1 * 6/2003 Kohler ..... E01F 15/141 52/745.18
2004/0025460 A1 * 2/2004 Terrels ..... E04F 11/1814 52/298
2004/0206028 A1 * 10/2004 Terrels ..... E04H 17/1447 52/287.1
2005/0160697 A1 * 7/2005 Oliphant ..... E04C 3/30 52/843
2005/0223675 A1 * 10/2005 Herron ..... E04C 2/20 52/630
2005/0229531 A1 * 10/2005 Green ..... F16B 12/46 52/834
2005/0252146 A1 * 11/2005 MacDonald ..... E04C 1/395 52/607
2005/0252147 A1 * 11/2005 MacDonald ..... E04C 1/395 52/745.09
2007/0163187 A1 * 7/2007 Price ..... E04F 13/0733 52/169.12
2007/0163203 A1 * 7/2007 Price ..... E04B 1/34342 52/834
2009/0056257 A1 * 3/2009 Mollinger ..... B44C 5/0461 52/309.4
2009/0120023 A1 * 5/2009 Hoggan ..... E04H 12/12 52/300
2010/0050568 A1 * 3/2010 Griffiths ..... E04F 13/0733 52/745.19
2010/0199588 A1 * 8/2010 Herron, III ..... E04C 2/328 52/800.1
2010/0319197 A1 * 12/2010 Kan ..... E04F 13/0736 29/897.32
2012/0151850 A1 * 6/2012 Cashman ..... E04F 13/0733 52/36.3
2013/0199125 A1 * 8/2013 Shupe ..... E04F 19/064 52/762
2015/0082719 A1 * 3/2015 Takahashi ..... E04B 1/58 52/298
2016/0069101 A1 * 3/2016 Pooch ..... E01F 8/0011 29/897.3
2017/0183840 A1 * 6/2017 Tozer ..... E02D 27/425
2017/0292275 A1 * 10/2017 Taylia ..... E04F 13/0894
2017/0347533 A1 * 12/2017 Volin ..... A01G 27/005
2018/0202168 A1 * 7/2018 Stuart ..... E04F 13/0803

* cited by examiner

HIGH STRENGTH, LOW DENSITY COLUMNAR STRUSTURE

PRIORITY CLAIM

This application is a continuation of, and claims benefit to, U.S. patent application Ser. No. 17/314,305, now U.S. Pat. No. 11,732,477, which was a continuation of U.S. patent application Ser. No. 16/728,233, now U.S. Pat. No. 11,002,013, which was a continuation of U.S. patent application Ser. No. 16/100,480, filed on Aug. 10, 2018, which issued as U.S. Pat. No. 10,519,658 on Dec. 31, 2019, and which are all hereby incorporated by reference in their entirety.

BACKGROUND OF THE INVENTION

Field of the Invention

The invention relates to high strength, low density structures in general and to columnar high strength, low density structures in particular.

Prior Art

Building structures and devices that can bear a similar or greater load than their predecessors with less material and less weight is an unending quest in engineering. Aircraft that weigh less but hold the same number of passengers or cargo, all else being equal, will cost less to operate. Likewise for cars and trucks. Witness Ford's much publicized switch from steel to aluminum for much of its frame, all done in the name of lowering weight and increasing vehicle efficiency. Oil platforms must be shipped to their destination. Shipping costs are expensive and directly related to weight. Once on site, the derrick legs must be provided with enough flotation to render them buoyantly neutral. Otherwise, the weight of thousands of feet of support legs descending from the rig would sink the vessel lowering the legs to the ocean floor. The more the legs weigh, the more flotation material is required. Support structures, such as those used for bridges and buildings, must be strong enough to carry the loads for which they are designed. Designs that allow these structures to carry the desired loads with less material will cost less to make and ultimately conserve raw materials. Examples go on and on. Doing more with less is a fundamental goal in structural engineering. Accordingly, a device meeting the following objectives is desired.

OBJECTS OF THE INVENTION

It is an object of the invention to provide a high strength low density columnar structure.

It is another object of the invention to provide a columnar structure that is modular.

It is still another object of the invention to provide a columnar structure that may be used in a variety of applications.

It is yet another object of the invention to provide a modular component that will effectively distribute compressive loads.

It is still another object of the invention to provide a series of modular components that are readily stackable.

It is yet another object of the invention to provide a columnar structure whose length may be readily adjusted.

It is still another object of the invention to provide a modular columnar structure that may be readily installed in a variety of applications.

SUMMARY OF THE INVENTION

A modular, high strength, low density columnar structure is disclosed. In the preferred embodiment, each module is a prism or a cuboid comprising three or four vertical rectangular sides which meet in the module corners. The ends of the module perpendicular to the sides are the faces of the module. At least one face is provided with a brace panel. Each brace panel will be generally the same shape as the face, but off-set relative to the face. A plurality of preferably triangular brace arms extends, one from each edge of the brace panel, to the module corners. Each brace panel is preferably provided with an aperture located in approximately the center of the panel. The lower face of each module is preferably provided with a lip. The upper face of each module is preferably configured to receive the lip. When modules are stacked, the lip of an upper module will be received by the upper face of the lower module. Each module is preferably provided with a centrally located column aligned with the aperture. When the modules are stacked, the central column of an upper module will engage the central column of a lower module, thereby facilitating the transference of compressive forces throughout the columnar structure.

A plurality of struts extends radially from the central columns. The struts extend between the faces of each module, which will facilitate the support and transfer of compressive forces. Some of the struts intersect with the brace arms, which will help support and distribute compressive forces. The struts preferably extend from the central column to the sides and corners of the module. This will resist compressive and torsional forces on the columnar structure.

A stack of modules may be secured to one another by running a bolt through the modules via the apertures in the brace panels and/or the columns, with an adhesive, or simply gravity. Once the columnar structure is formed it may be used in a variety of applications.

DETAILED DESCRIPTION OF THE BEST MODE

Figure 1:
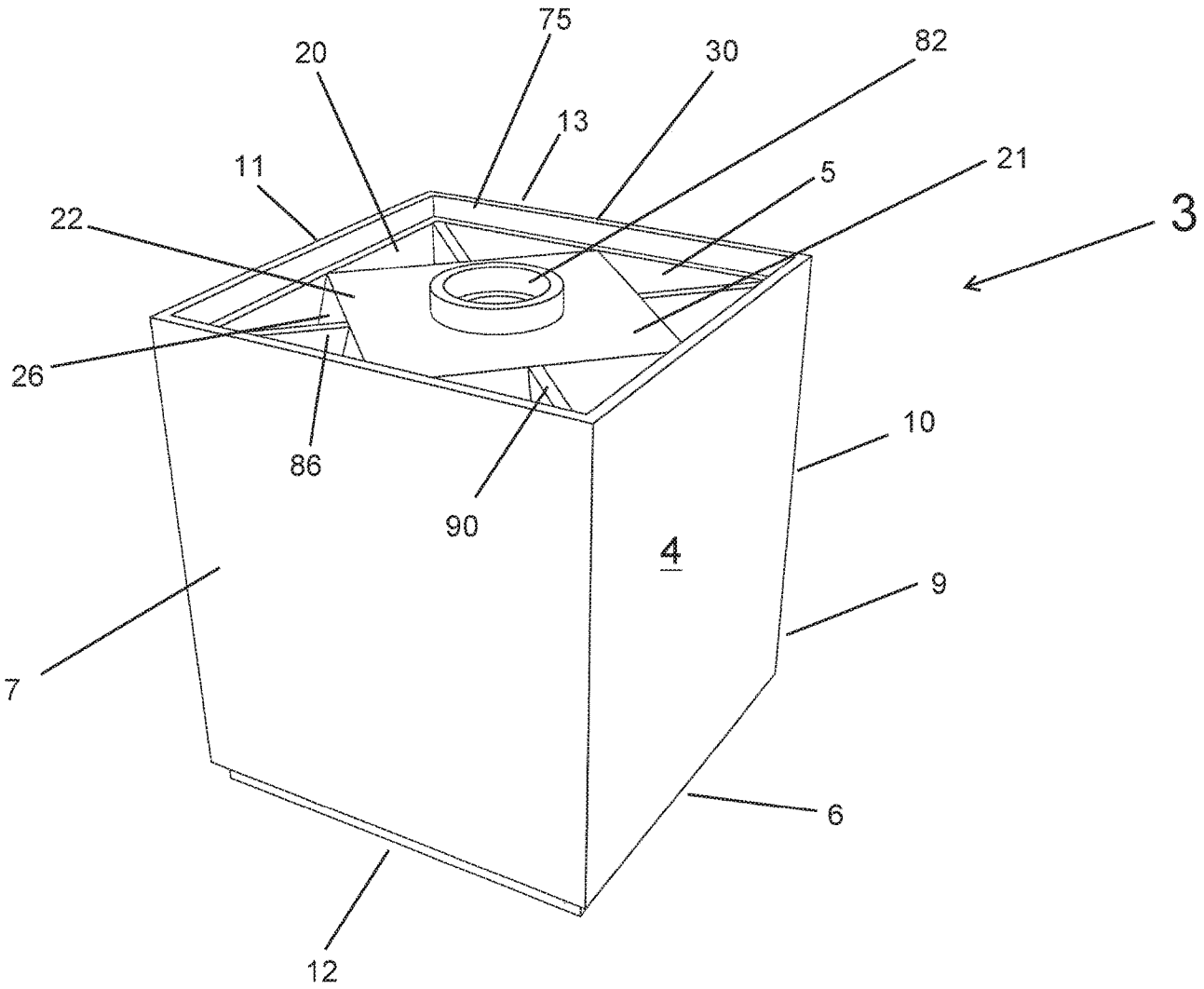
FIG. 1 is a perspective view of a preferred embodiment of a modular cuboid.
Figure 2A:
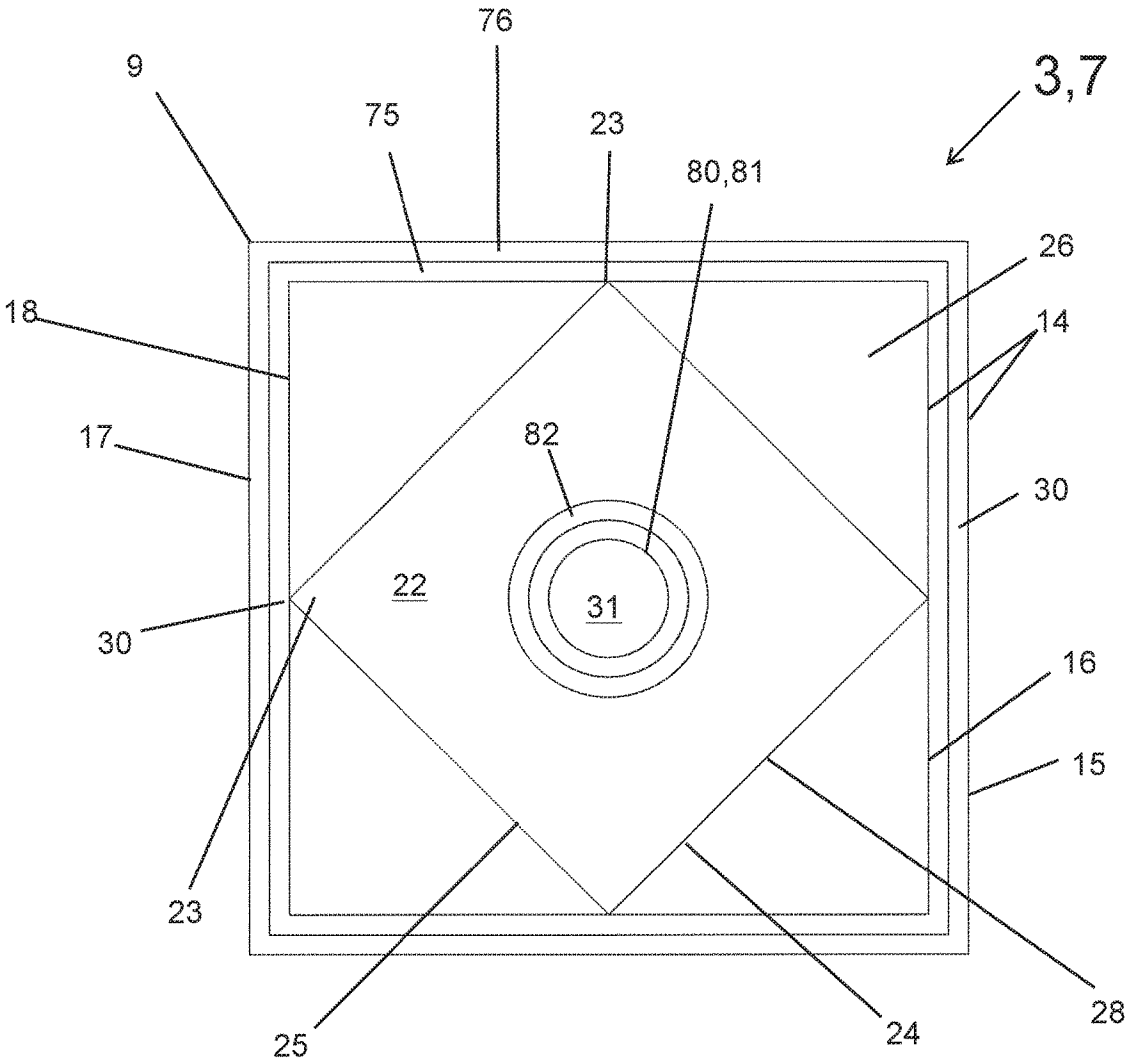
FIG. 2A is a top plan view of a preferred embodiment of a modular cuboid with one set of struts.
Figure 2B:
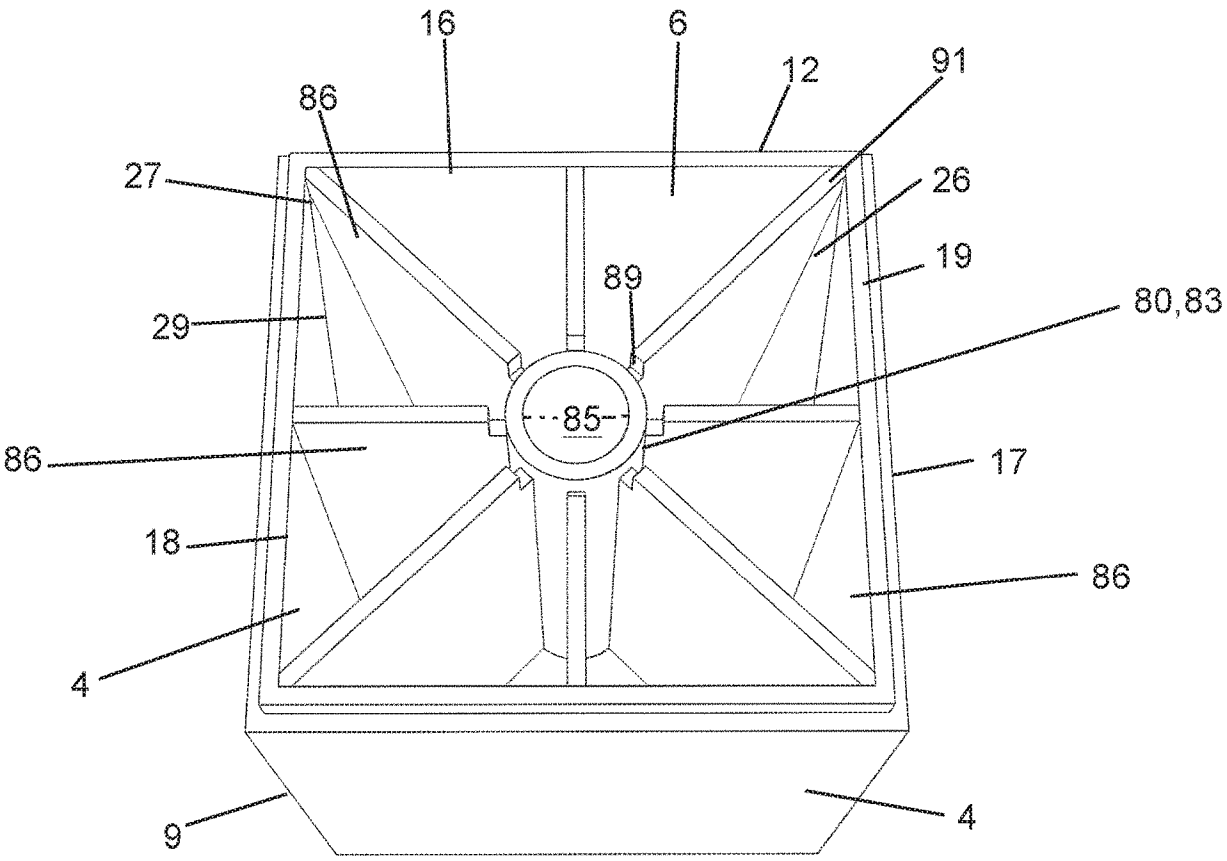
FIG. 2B is a bottom perspective view of a preferred embodiment of a modular cuboid with two sets of struts.
Figure 2C:
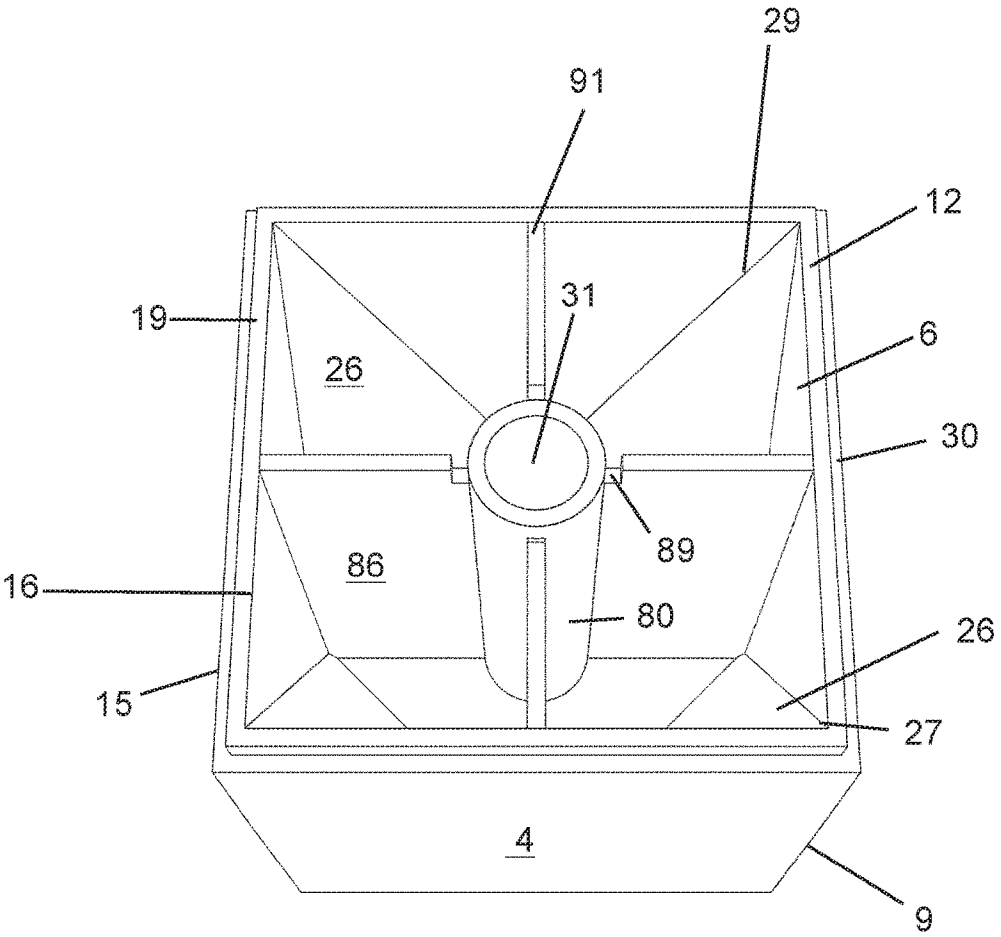
FIG. 2C is a bottom perspective view of a preferred embodiment of a modular cuboid with one set of struts.
Figure 3:
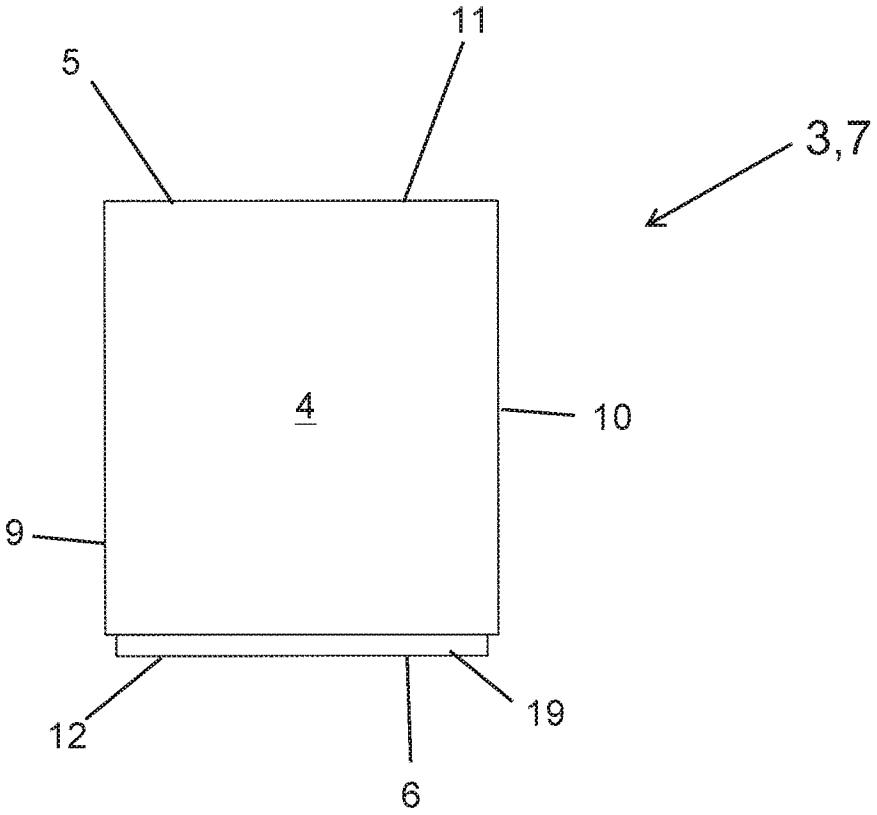
FIG. 3 is a side view of a preferred embodiment of a modular cuboid.
Figure 4:
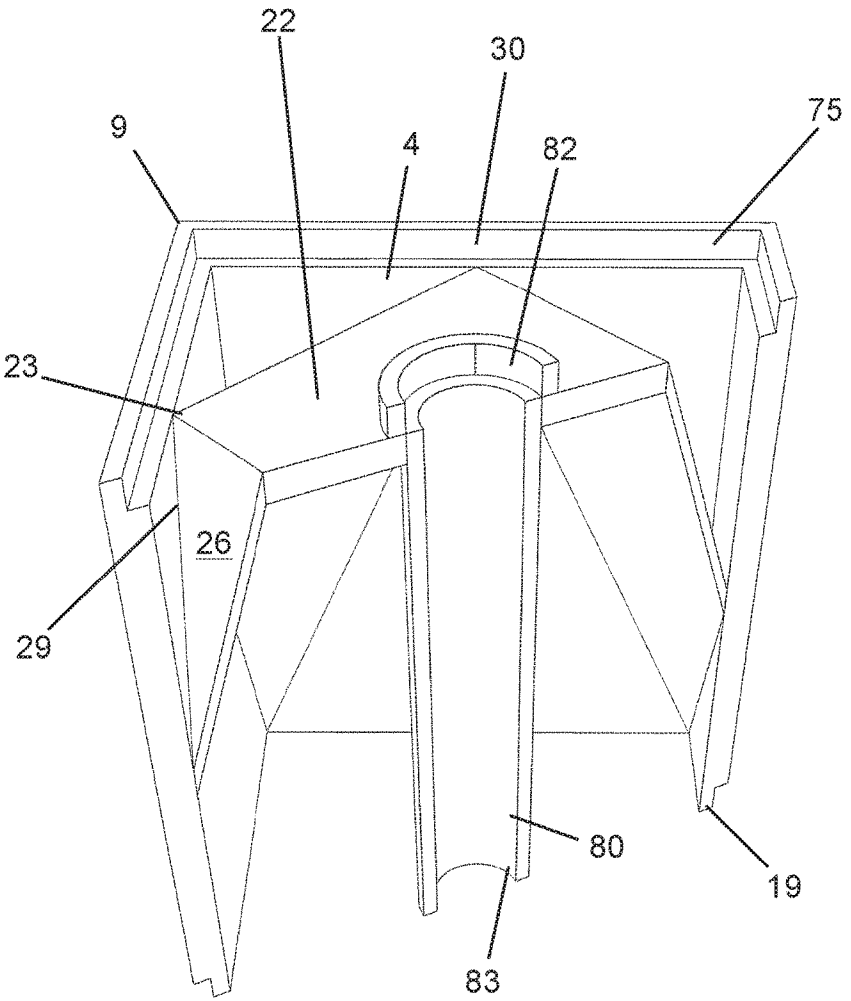
FIG. 4 is a perspective cut-away view of a preferred embodiment of a modular cuboid with no struts.
Figure 4A:
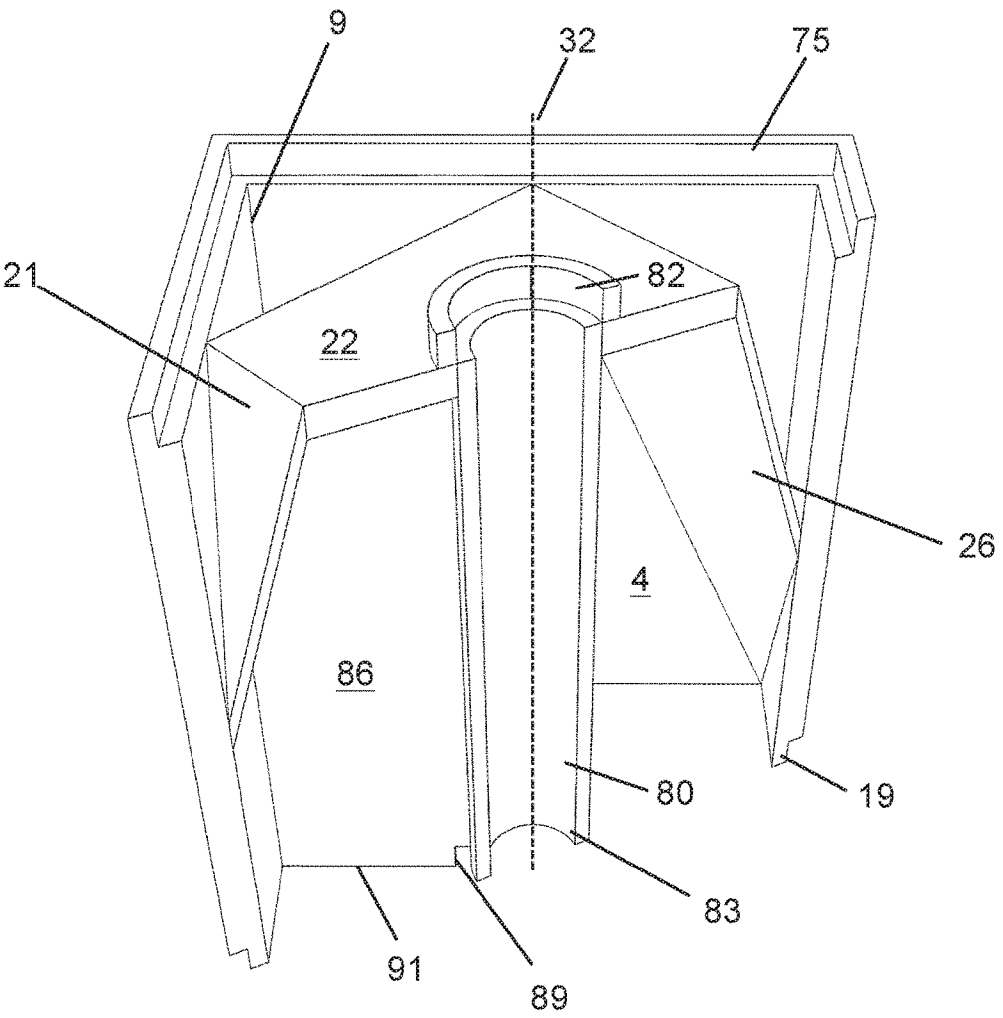
FIG. 4A is a perspective cut-away view of a preferred embodiment of a modular cuboid with one set of struts.
Figure 4B:
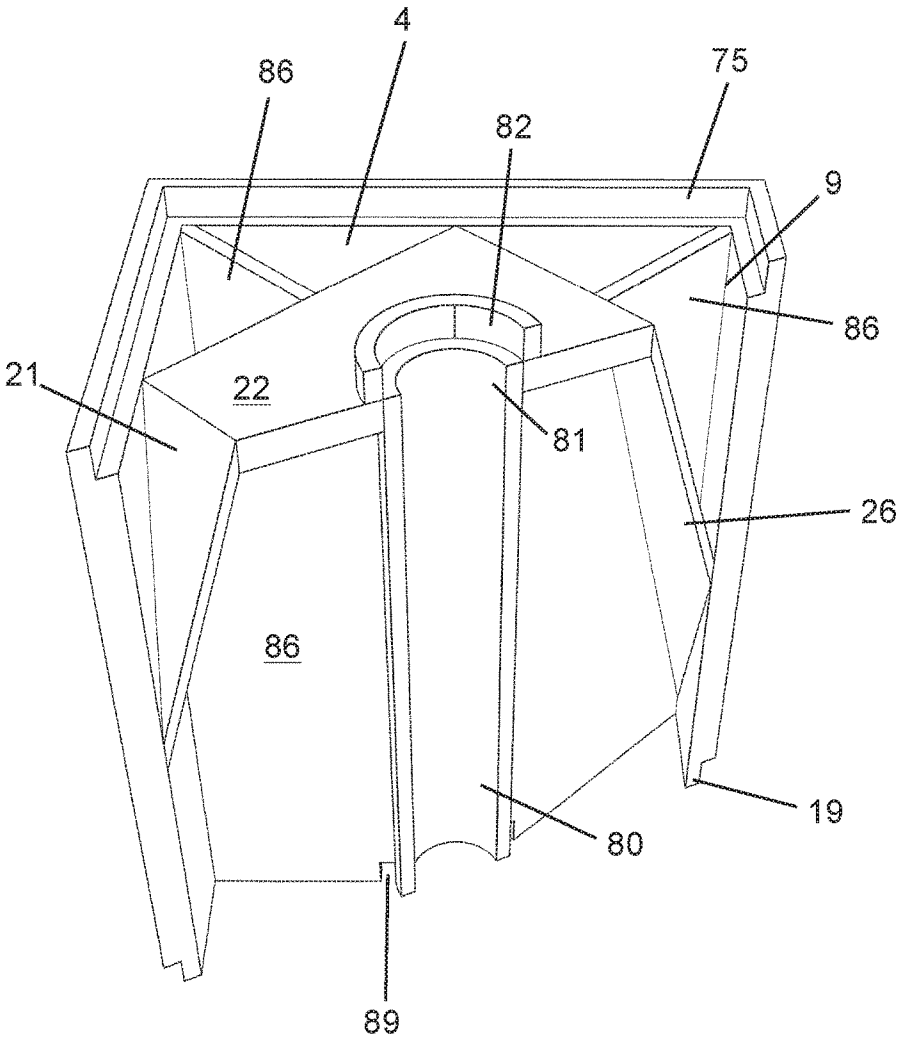
FIG. 4B is a perspective cut-away view of a preferred embodiment of a modular cuboid with two sets of struts.
Figure 5:
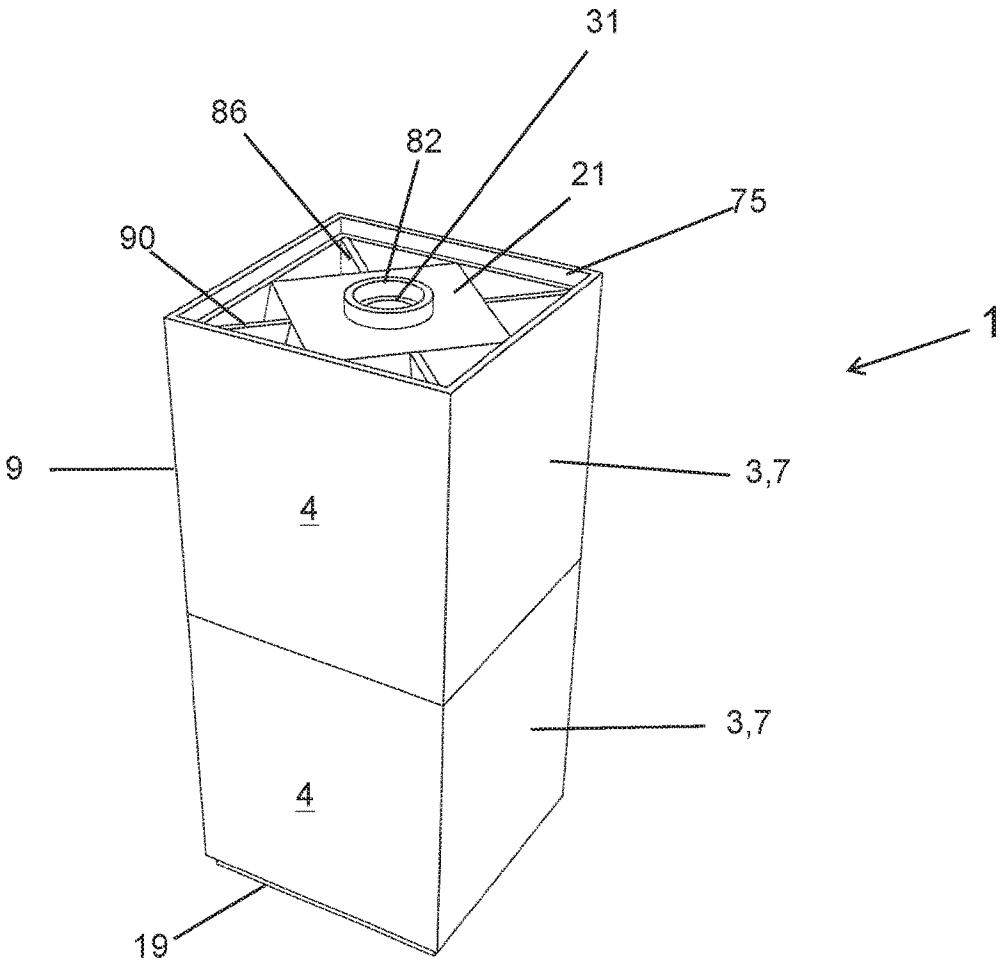
FIG. 5 is a perspective view of two modular cuboids vertically aligned.
Figure 6:
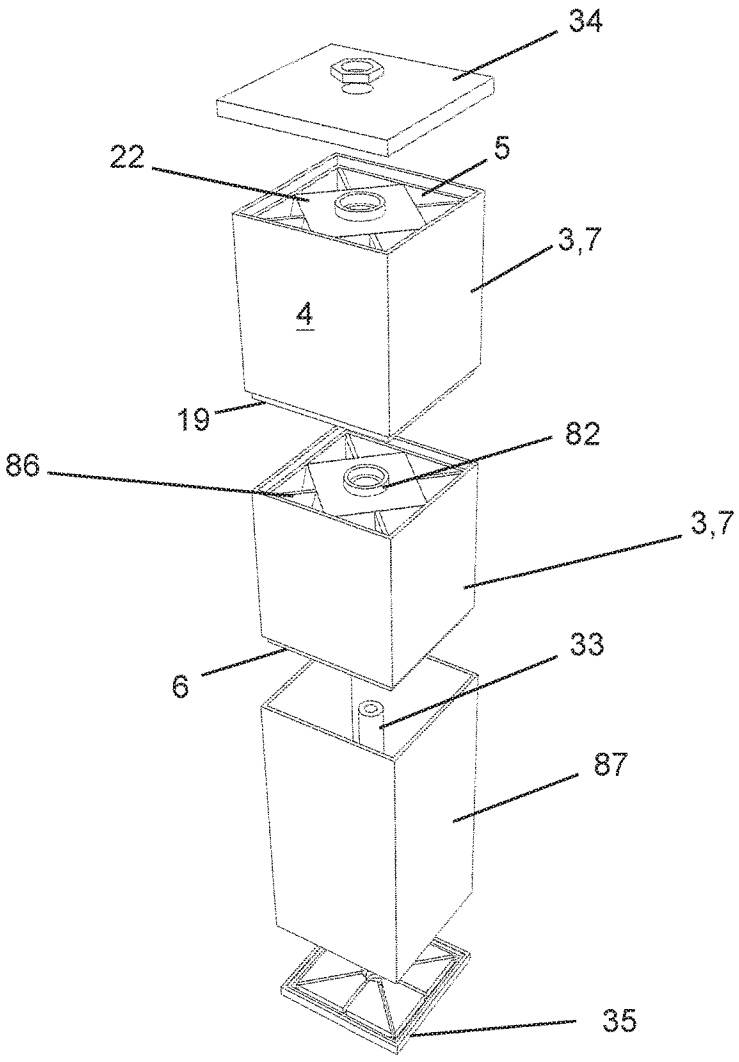
FIG. 6 is a perspective exploded view of a preferred embodiment of a columnar structure comprising two modular cuboids, a matching housing, a central bolt, and two caps.
Figure 7:
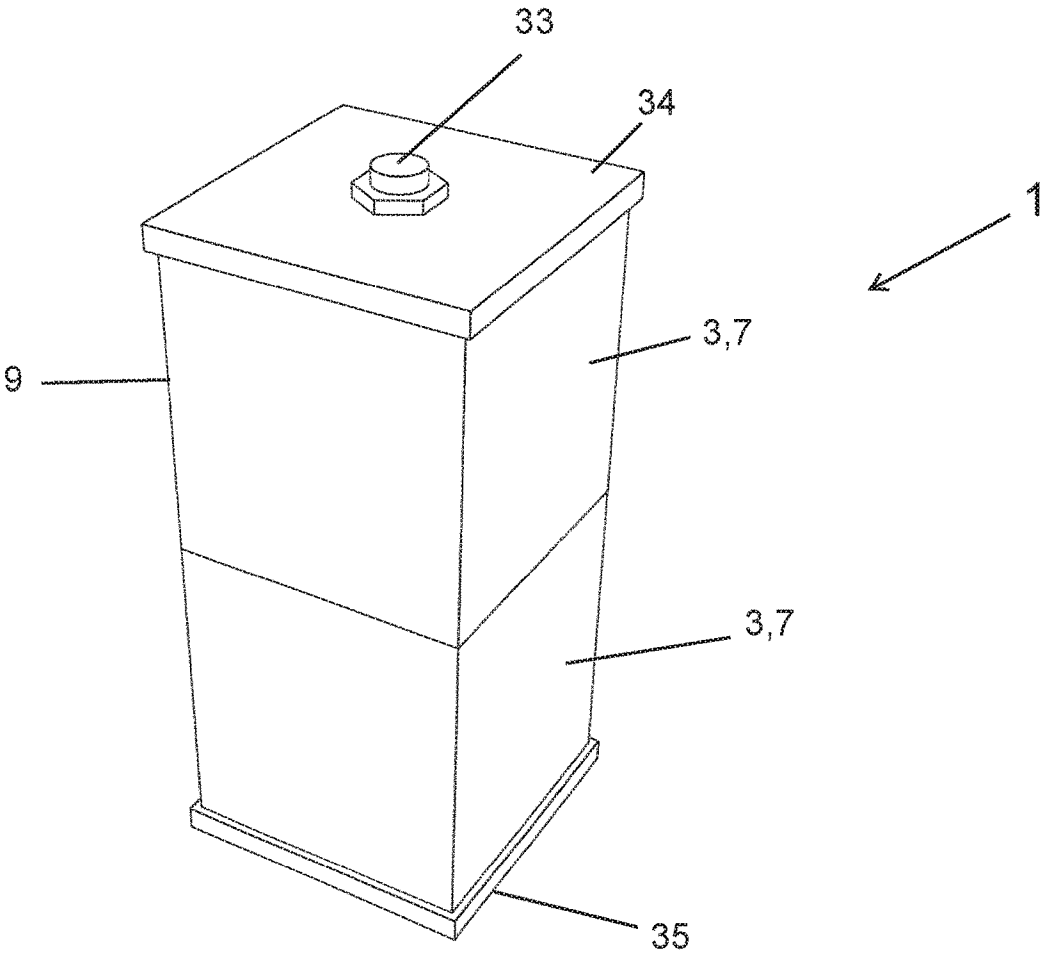
FIG. 7 is a perspective view of one embodiment of the columnar structure shown assembled.
Figure 8:
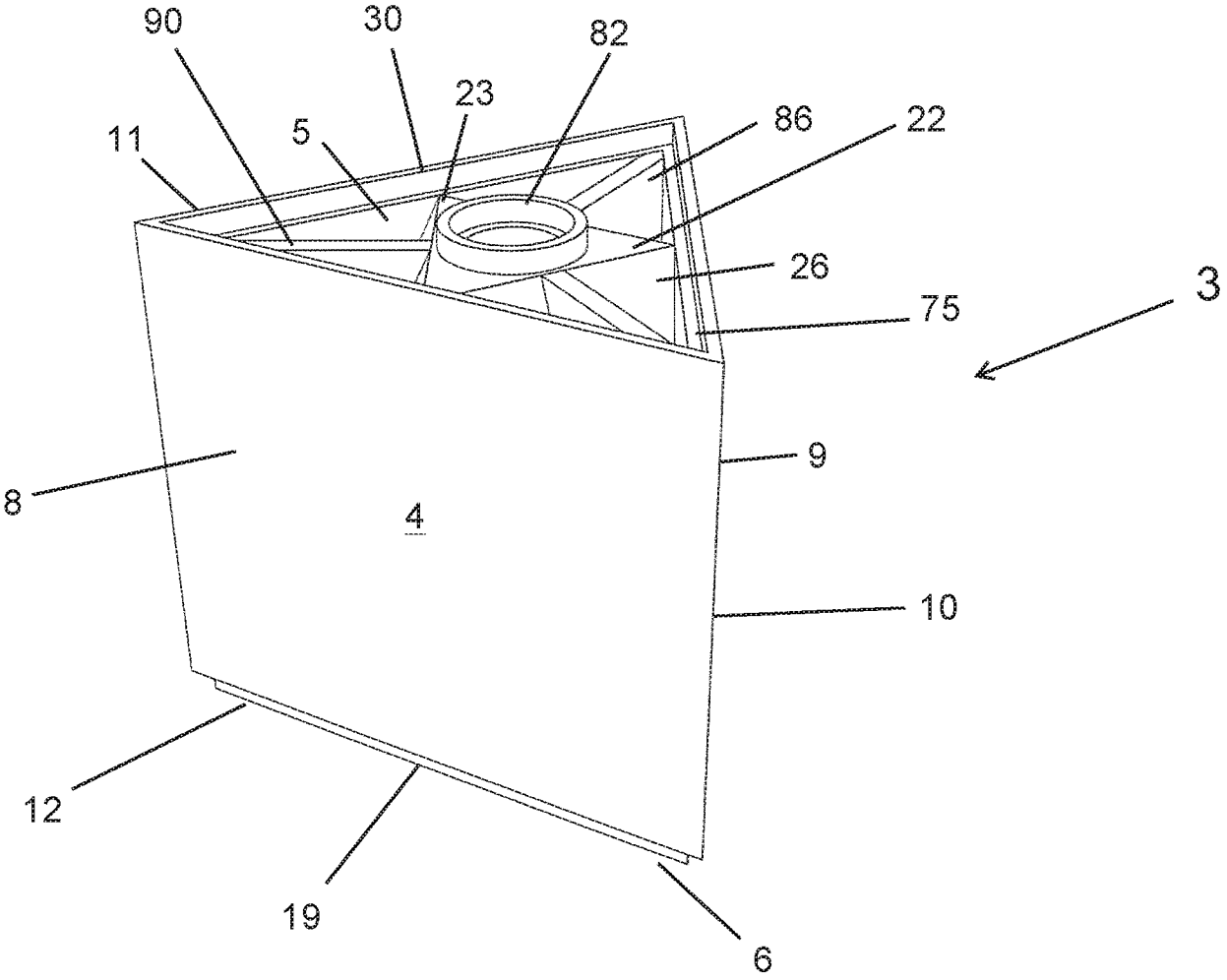
FIG. 8 is a perspective view of a preferred embodiment of a modular prism.
Figure 9A:
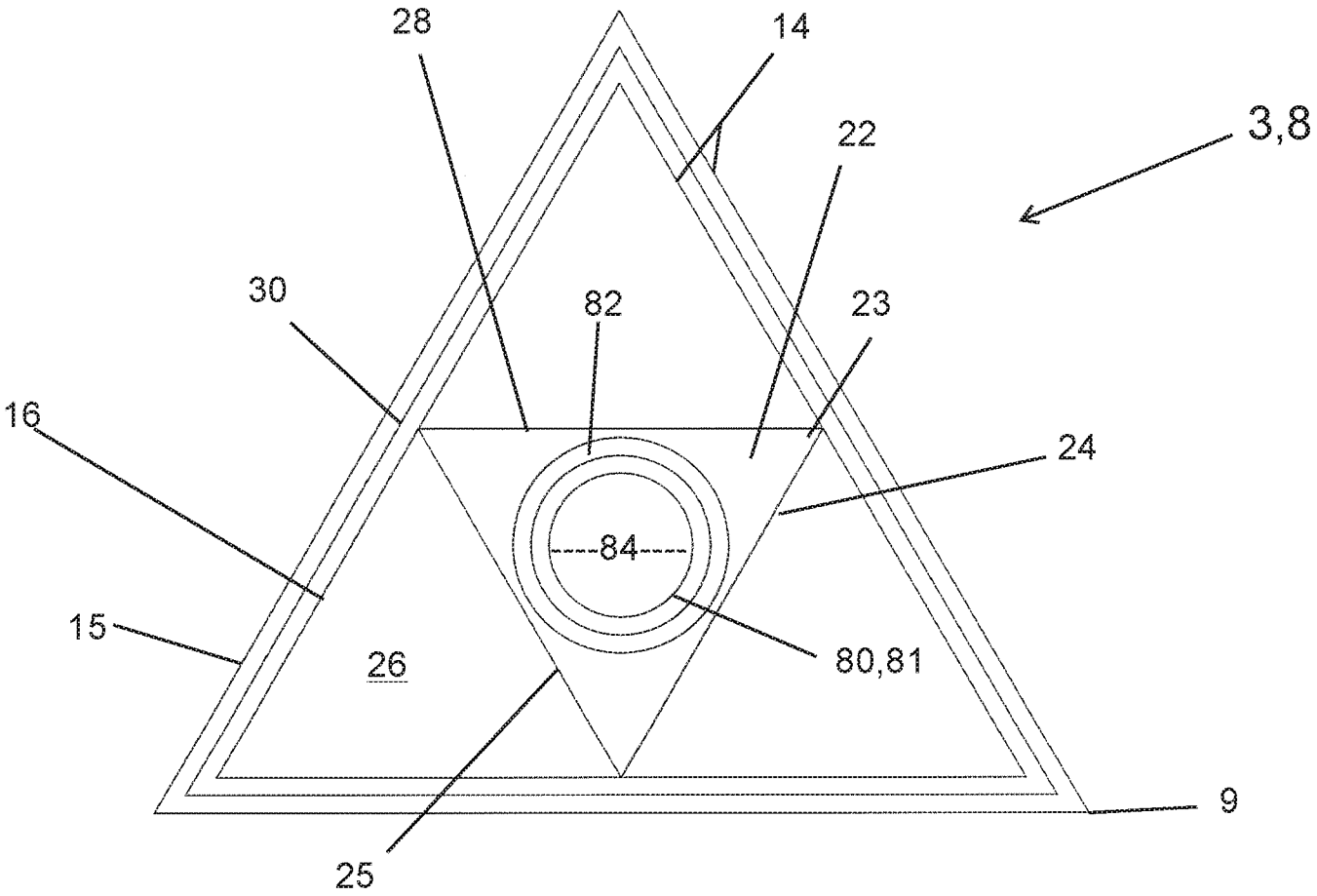
FIG. 9A is a top plan view of a preferred embodiment of a modular prism with one set of struts.
Figure 9B:
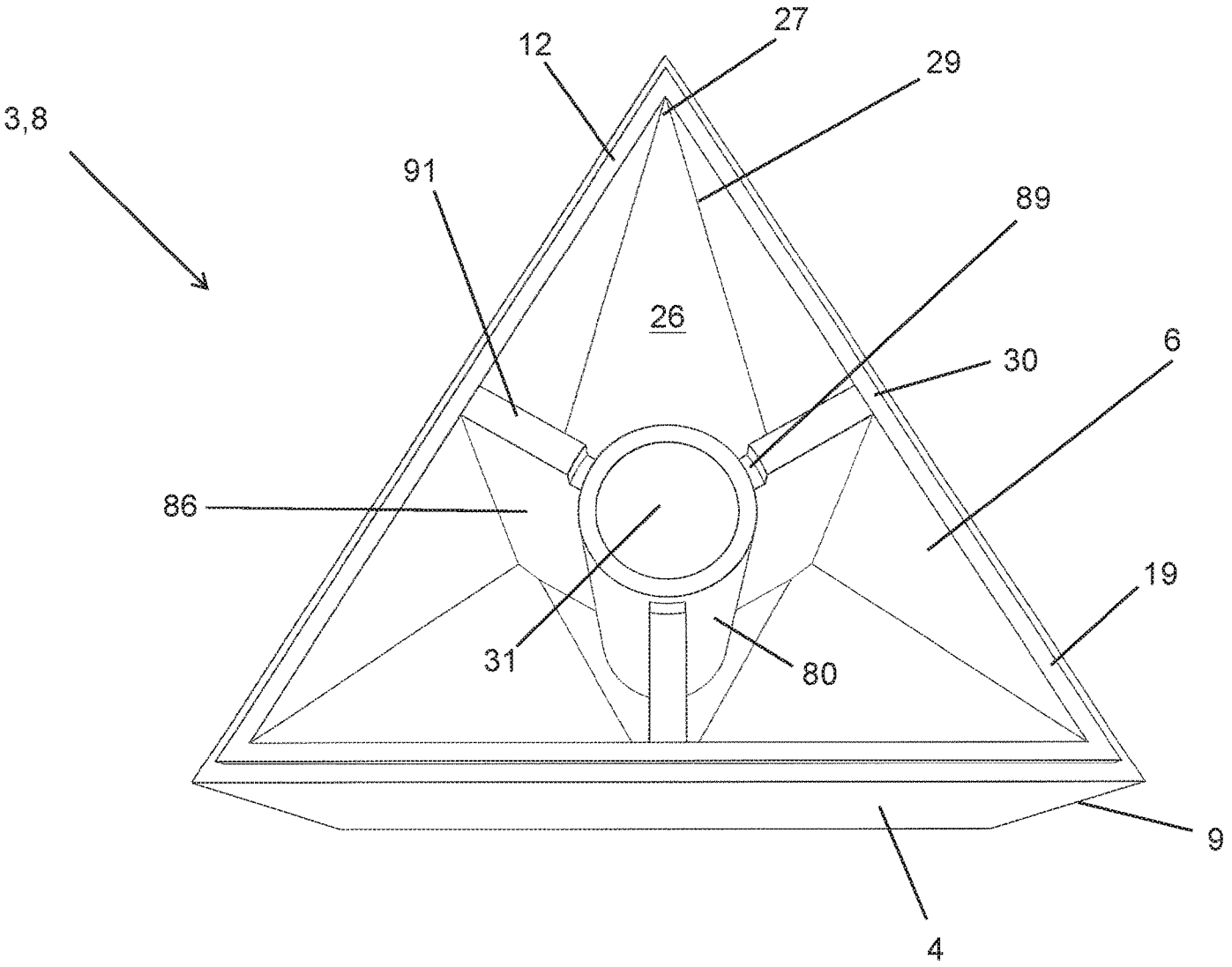
FIG. 9B is a bottom perspective view of a preferred embodiment of a modular prism with one sets of struts.
Figure 9C:
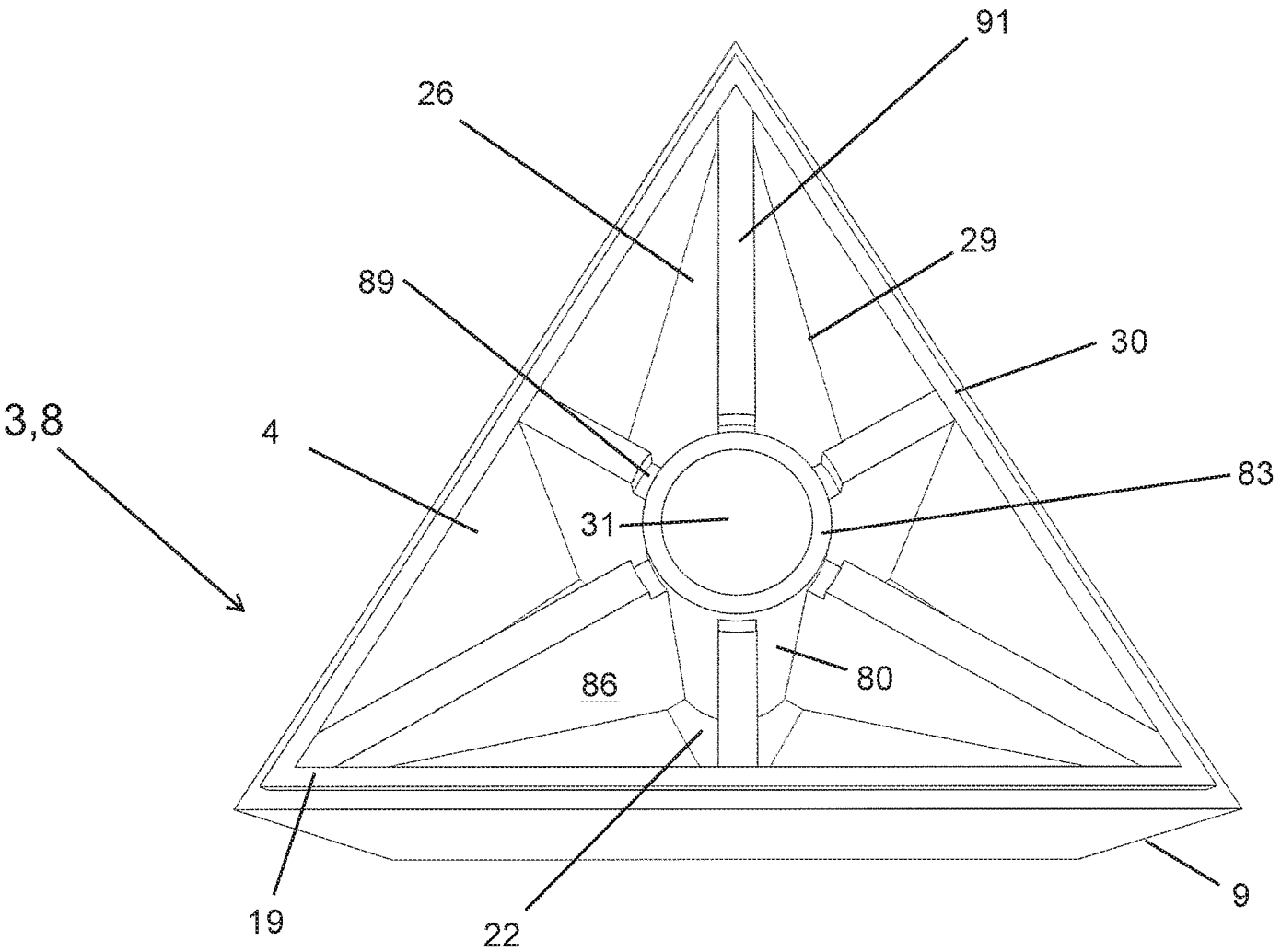
FIG. 9C is a bottom perspective view of a preferred embodiment of a modular prism with two sets of struts.
Figure 10:
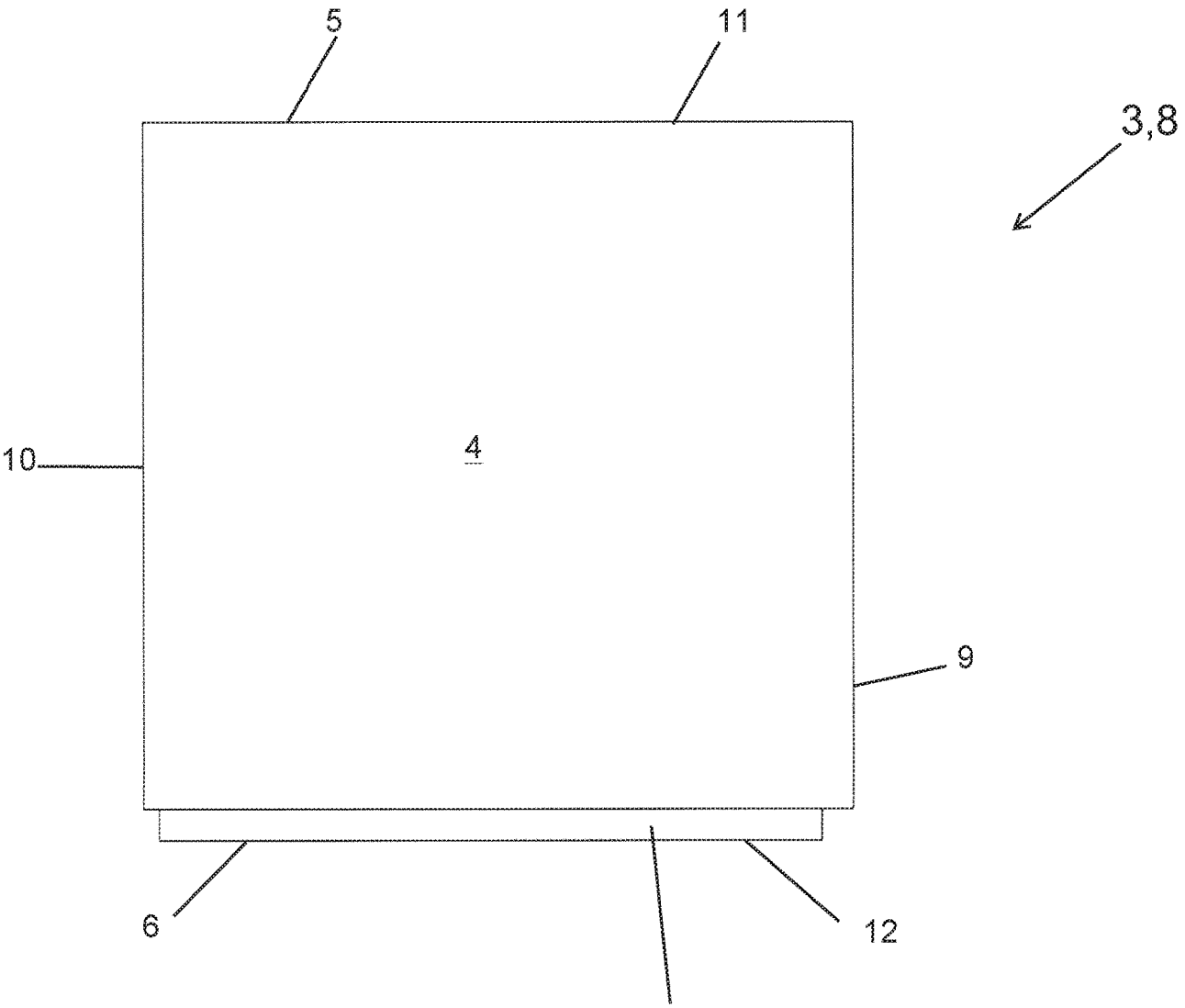
FIG. 10 is a side view of a preferred embodiment of a modular prism.
Figure 10A:
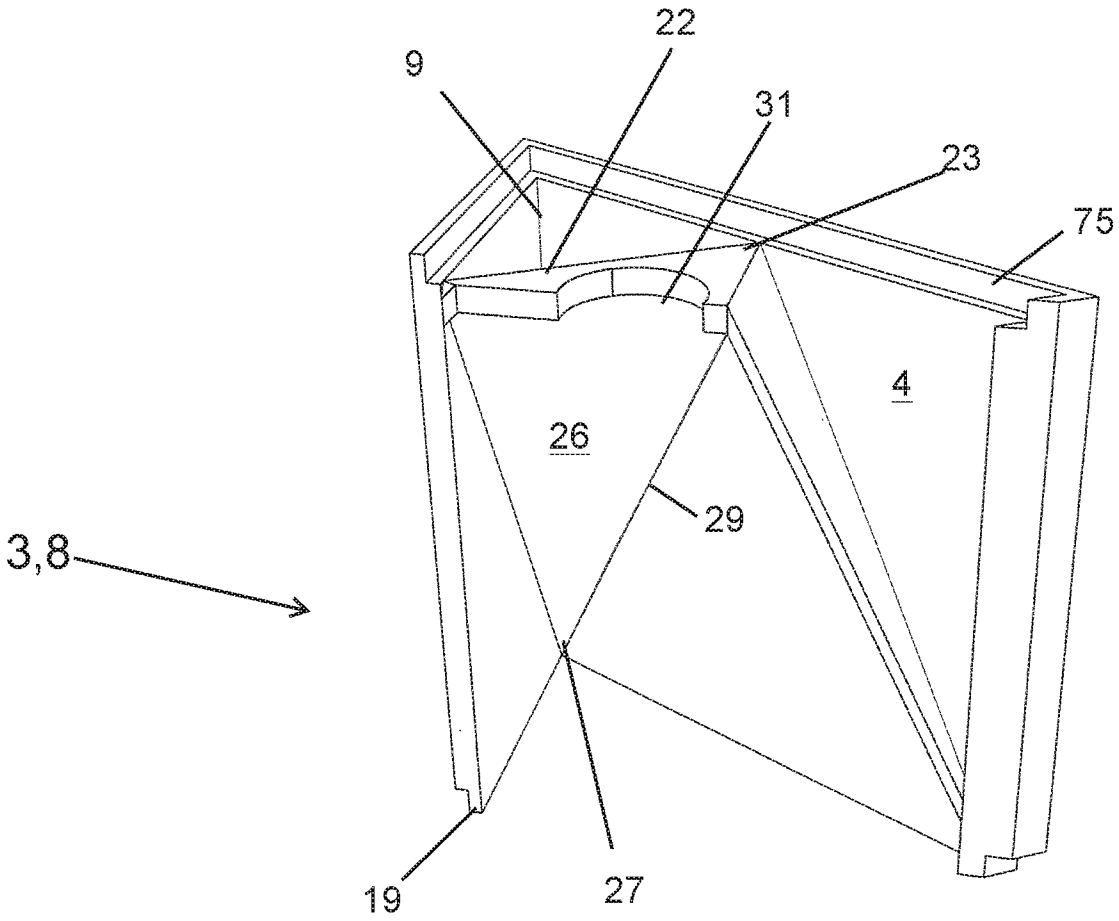
FIG. 10A is a cut-away side view of a preferred embodiment of a modular prism with no struts, and no central column.
Figure 10B:
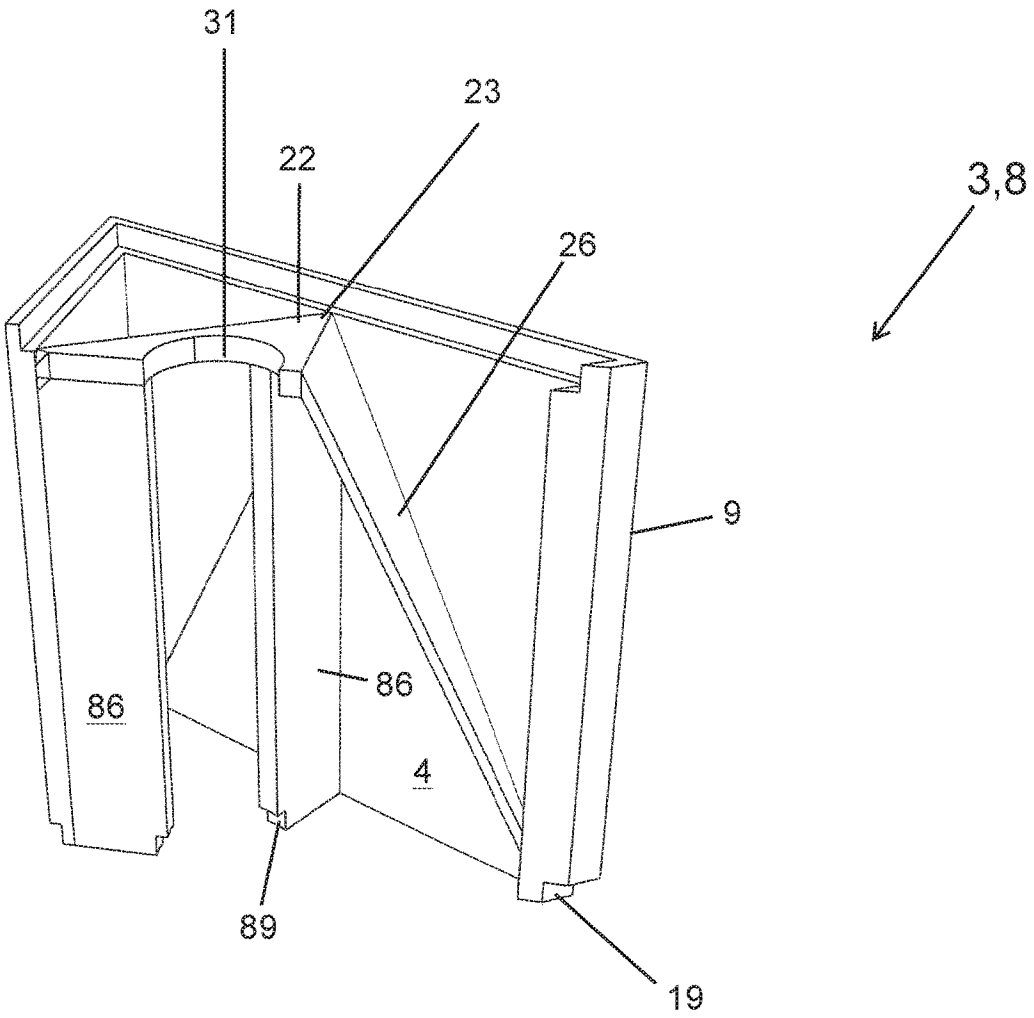
FIG. 10B is a cut-away side view of a preferred embodiment of a modular prism with one set of struts and no central column.
Figure 10C:
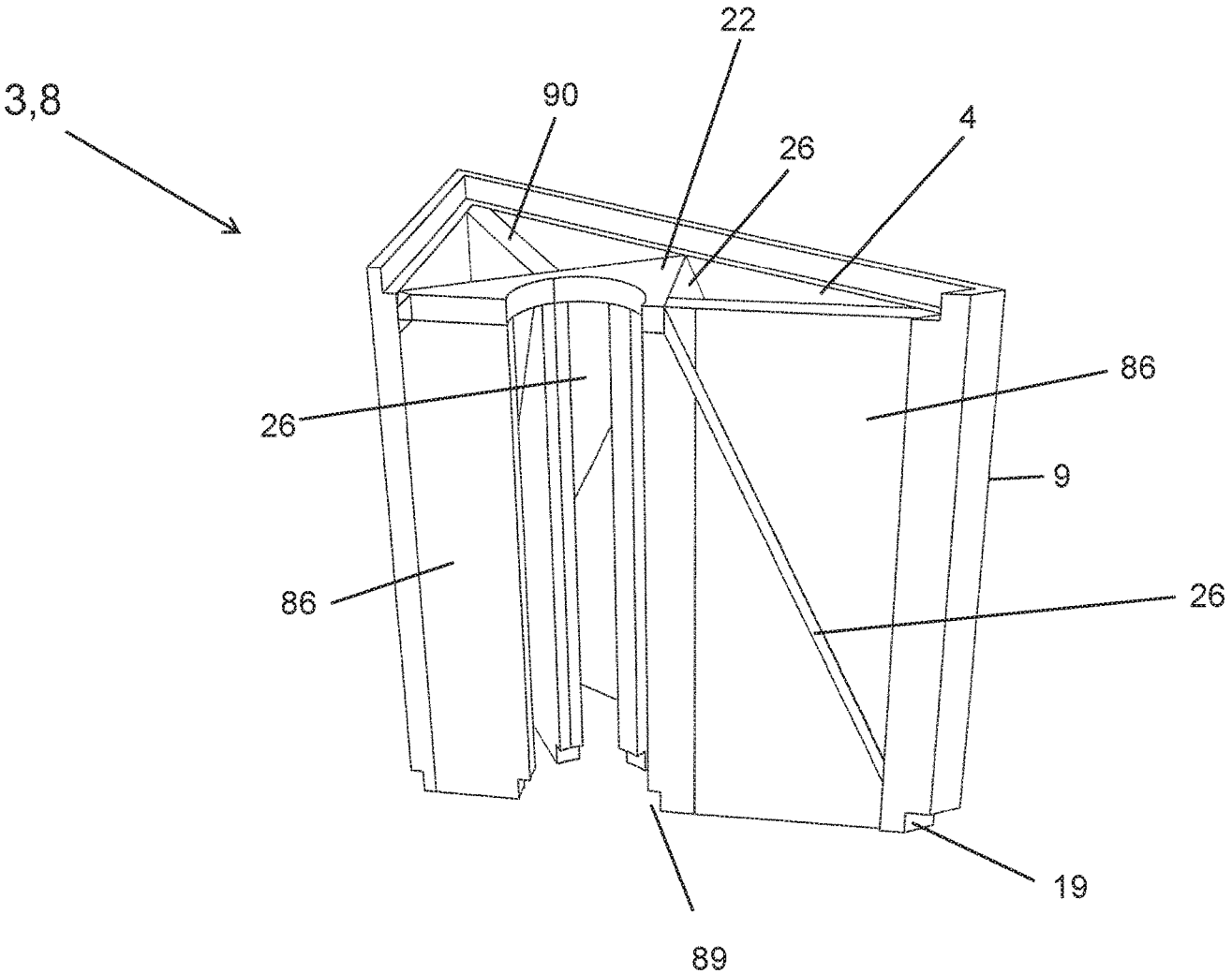
FIG. 10C is a cut-away side view of a preferred embodiment of a modular prism with two sets of struts and no central column.
Figure 11:
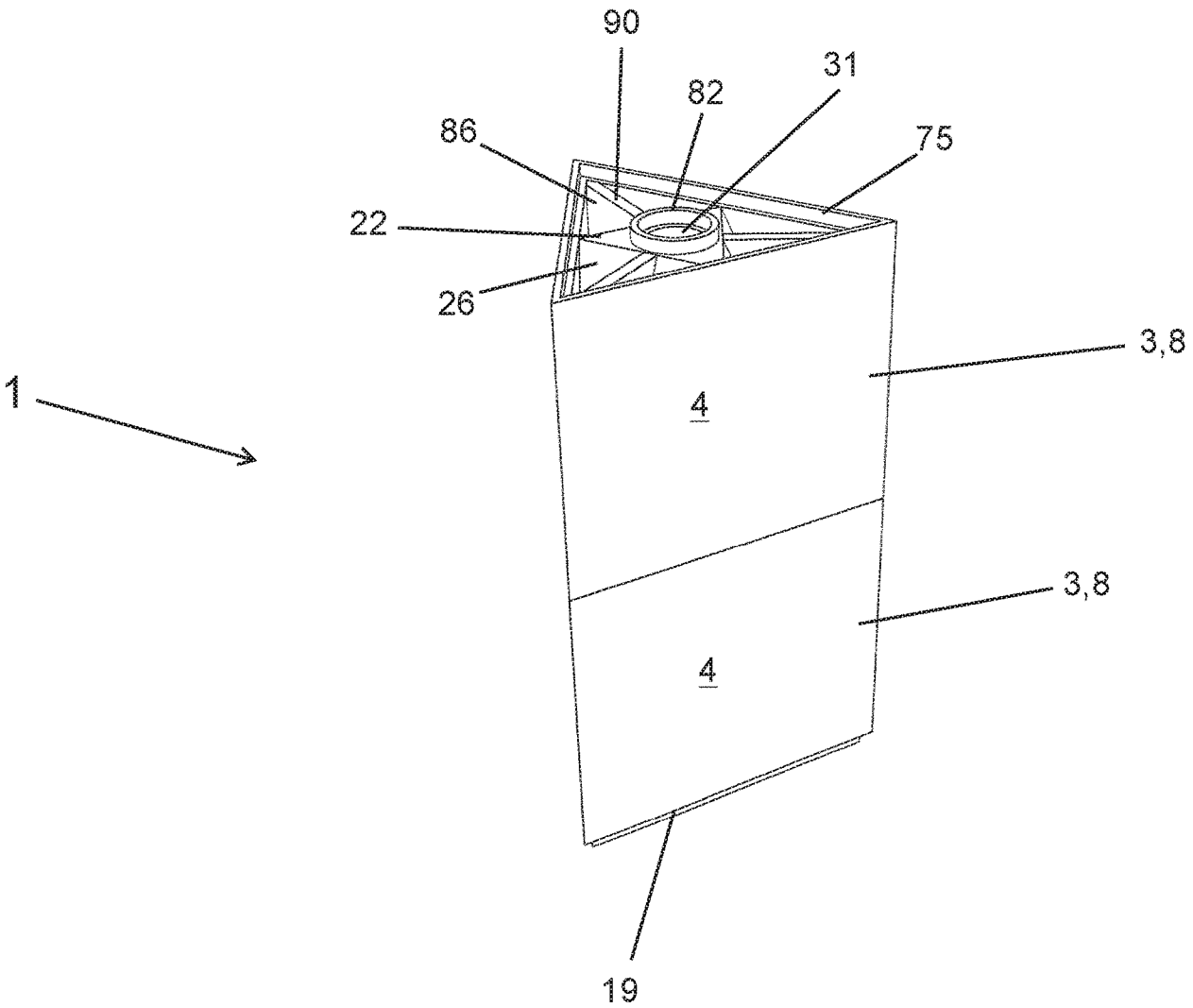
FIG. 11 is a perspective view of two modular prisms vertically aligned.
Figure 12:
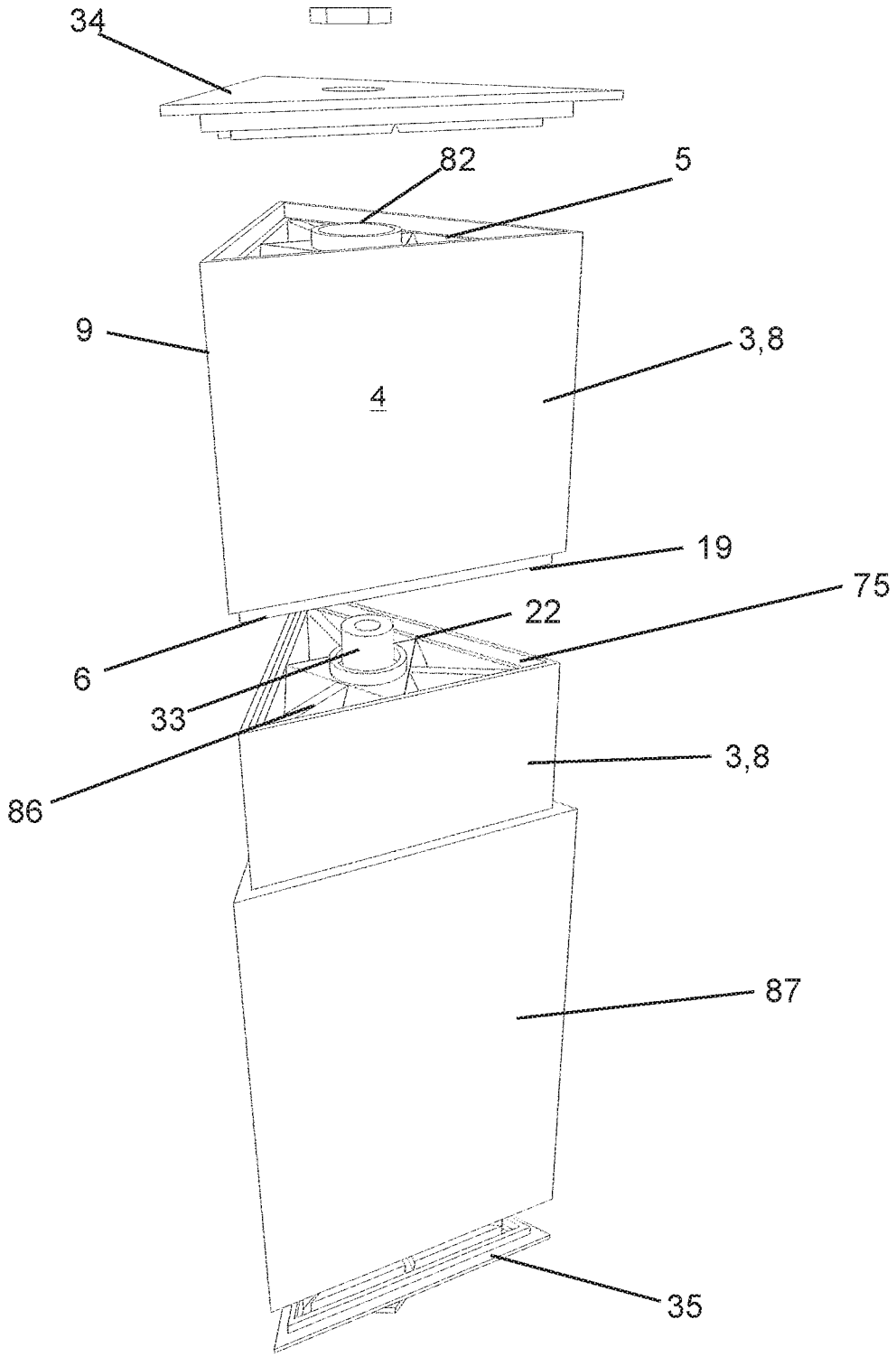
FIG. 12 is a perspective exploded view of a preferred embodiment of a columnar structure comprising two modular prisms, a matching housing, a central bolt, and two caps.
Figure 13:
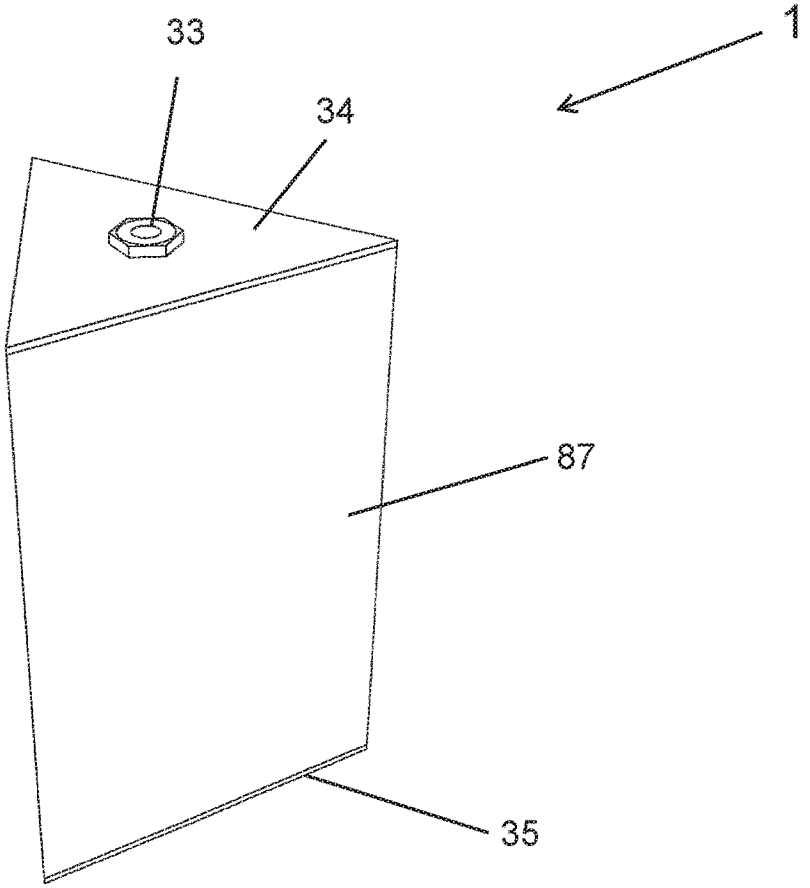
FIG. 13 is a perspective view of the embodiment of the columnar structure illustrated in FIG. 12 shown assembled.
Figure 14B:
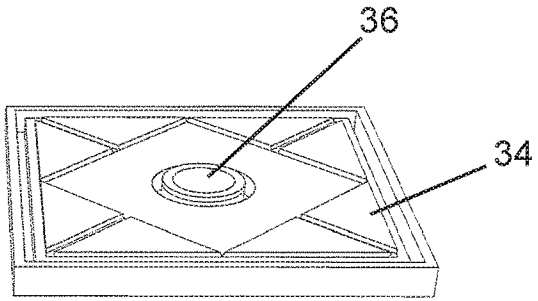
FIG. 14B is a perspective interior view of a preferred embodiment of a top cap for a cuboid embodiment of columnar structure.
Figure 14D:
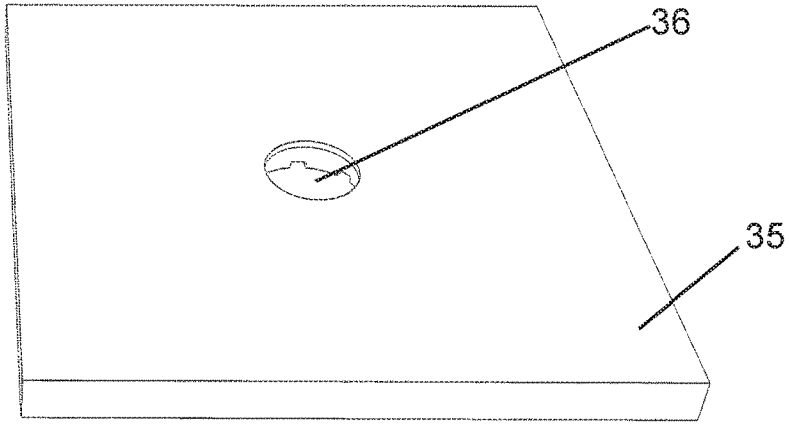
FIG. 14D is a perspective exterior view of a preferred embodiment of a bottom cap for a cuboid embodiment of columnar structure.
Figure 14A:
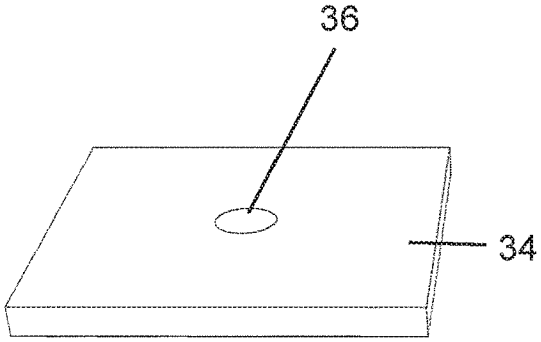
FIG. 14A is a perspective exterior view of a preferred embodiment of a top cap for a cuboid embodiment of columnar structure.
Figure 14C:
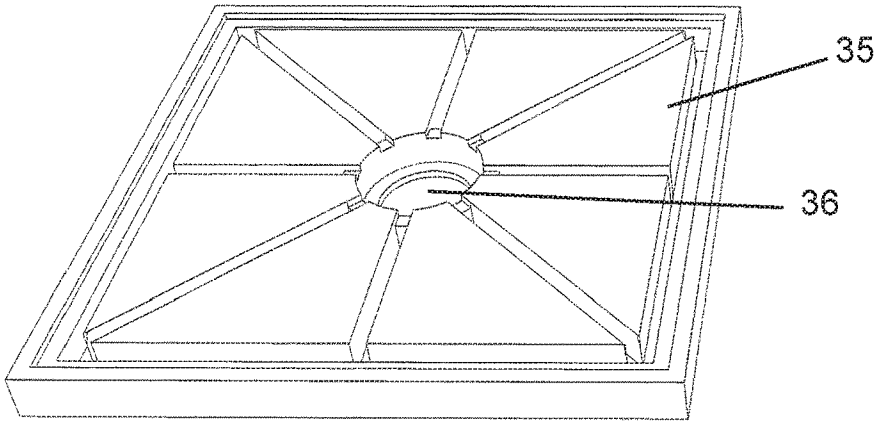
FIG. 14C is a perspective interior view of a preferred embodiment of a bottom cap for a cuboid embodiment of columnar structure.
Figure 15B:
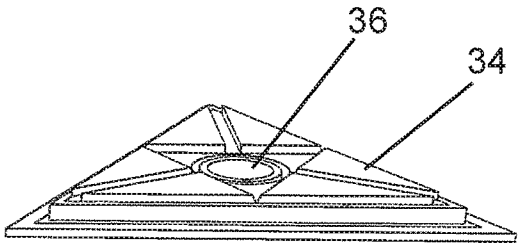
FIG. 15B is a perspective interior view of a preferred embodiment of a top cap for a prismatic embodiment of columnar structure.
Figure 15D:
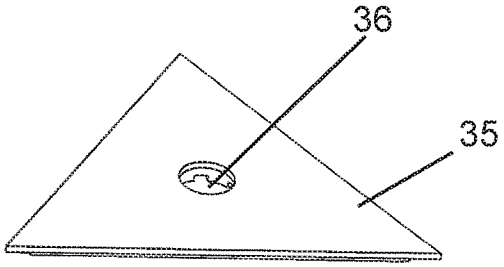
FIG. 15D is a perspective exterior view of a preferred embodiment of a bottom cap for a prismatic embodiment of columnar structure.
Figure 15A:
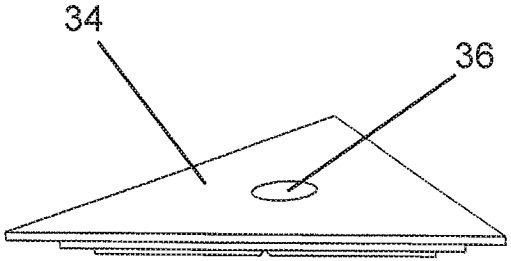
FIG. 15A is a perspective exterior view of a preferred embodiment of a top cap for a prismatic embodiment of columnar structure.
Figure 15C:
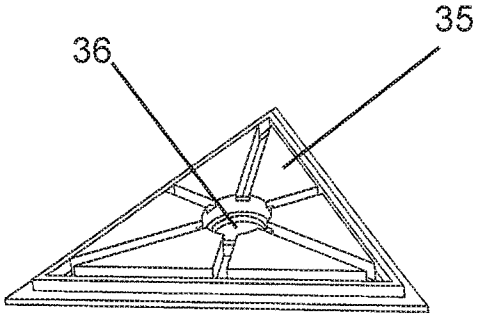
FIG. 15C is a perspective interior view of a preferred embodiment of a bottom cap for a prismatic embodiment of columnar structure.
Figure 16:
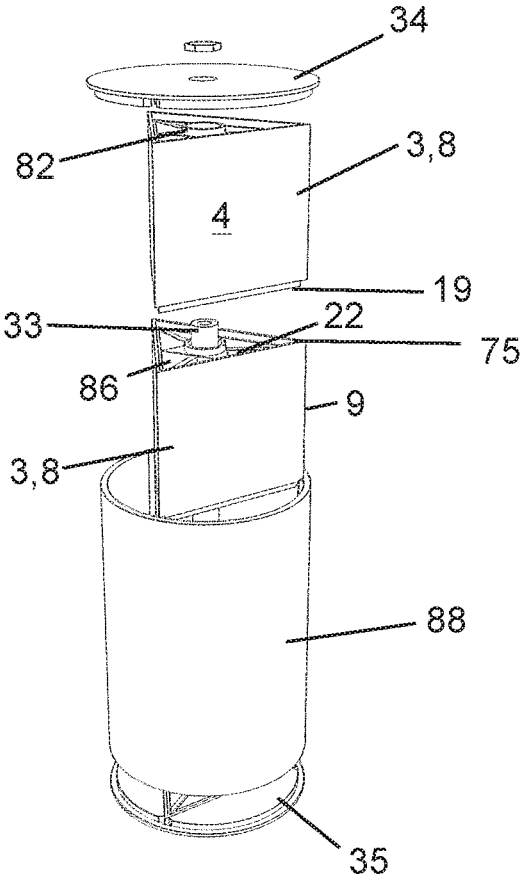
FIG. 16 is a perspective exploded view of a columnar structure comprising two modular prisms, a circular housing, a central bolt, and two caps.
Figure 17:
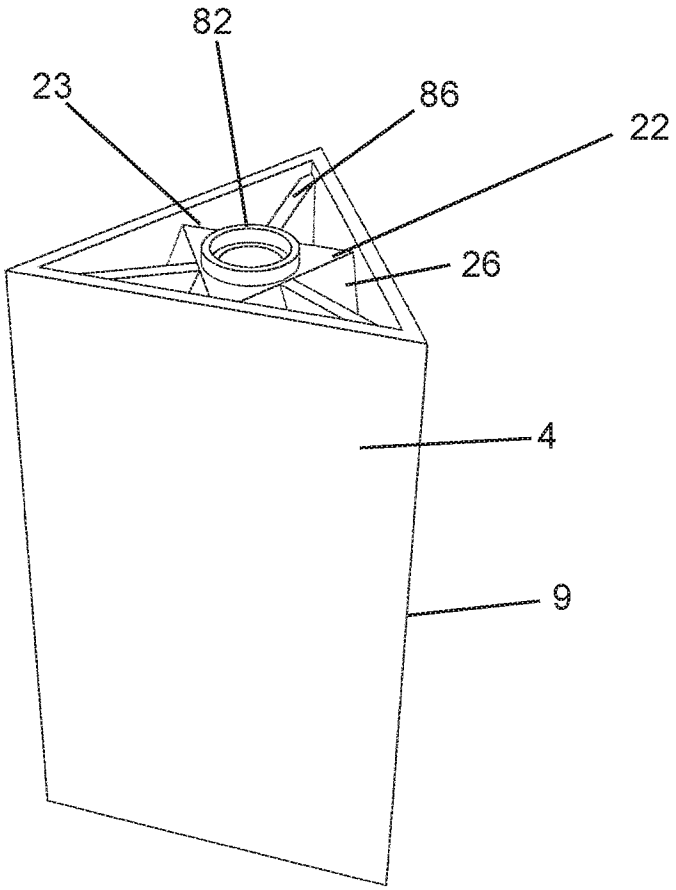
FIG. 17 illustrates a preferred embodiment of an integral columnar structure comprising two modular prisms and no housing.
Figure 18A:
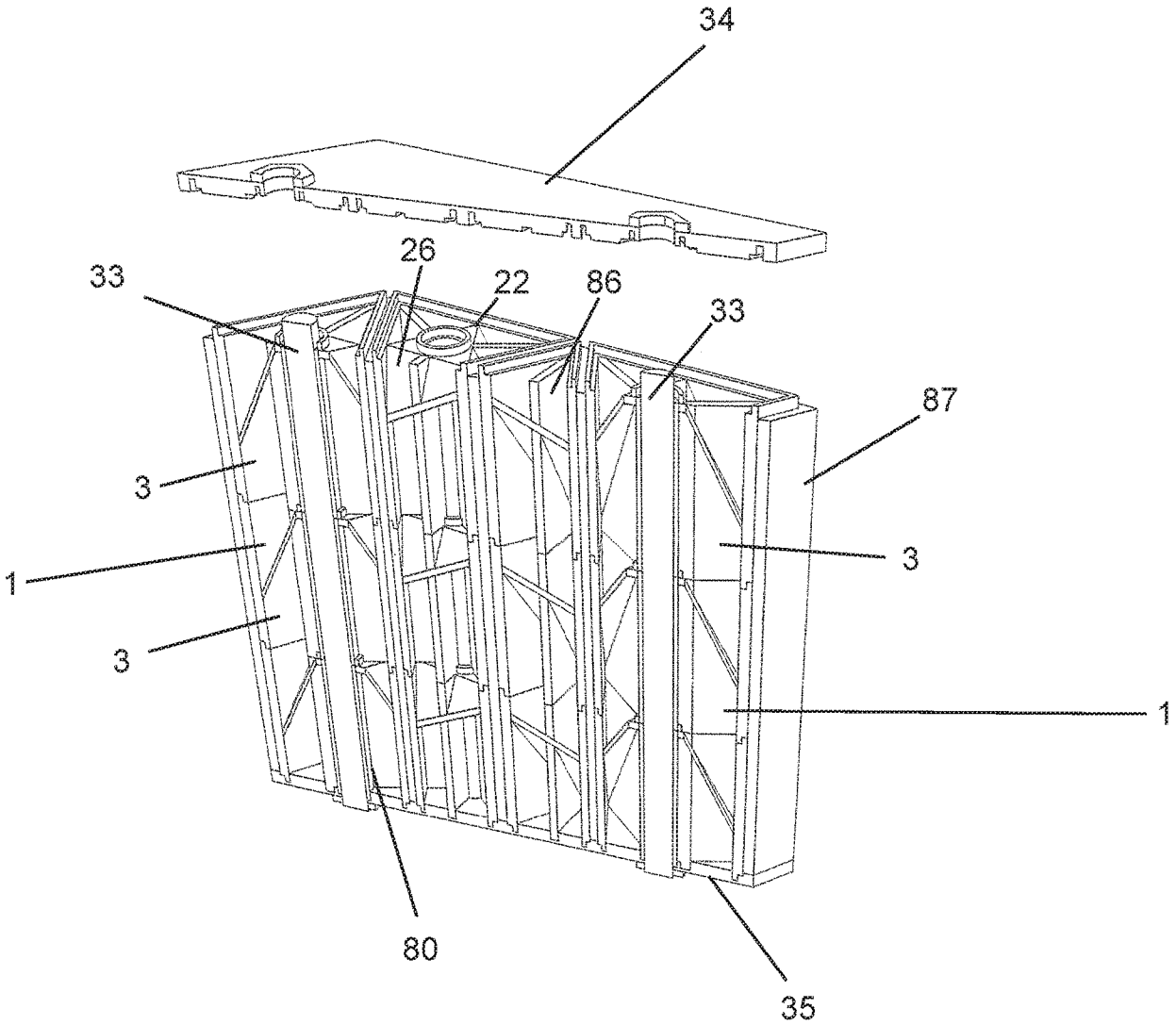
FIG. 18A is a perspective, partially exploded view of wall formed of a plurality of prismatic columnar structures.
Figure 18B:
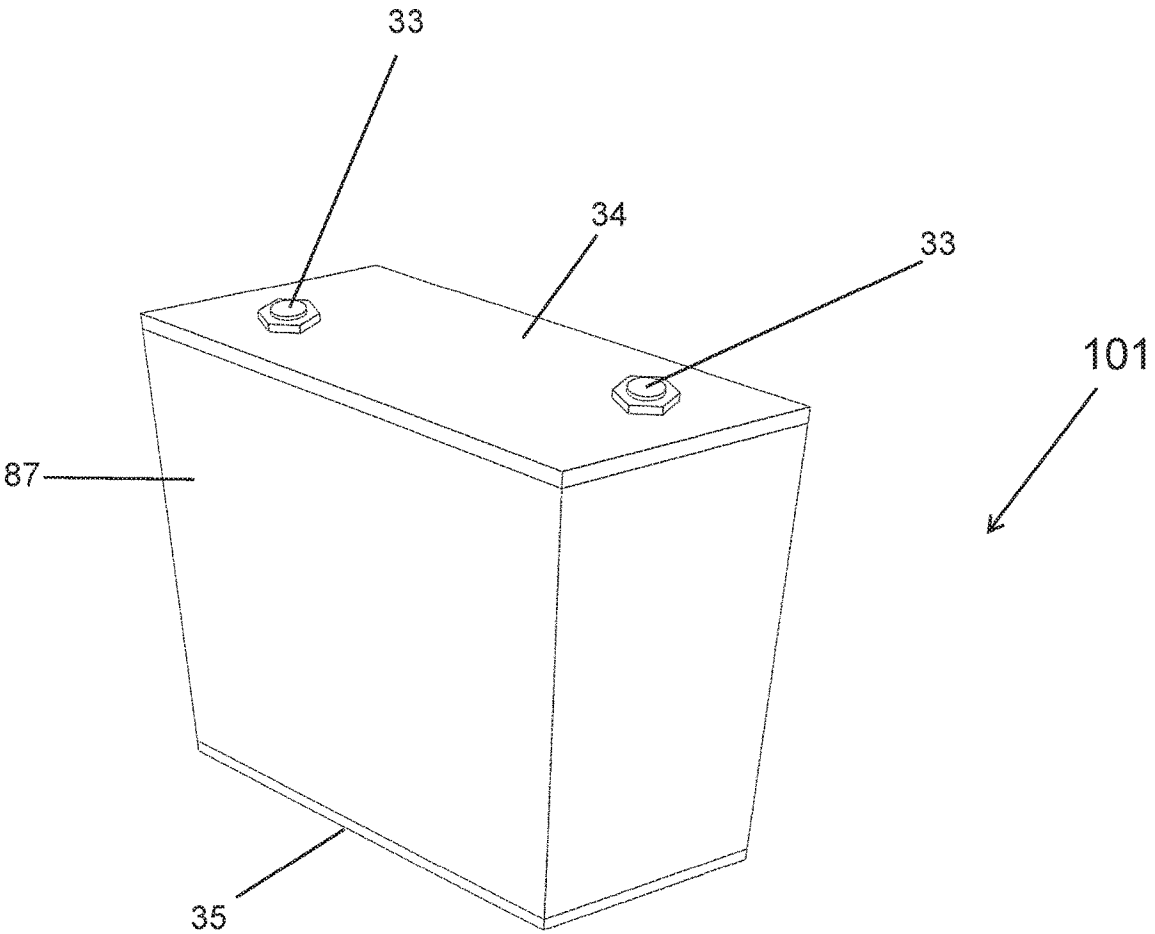
FIG. 18B is a perspective view of a wall formed of columnar structures.
Figure 19:
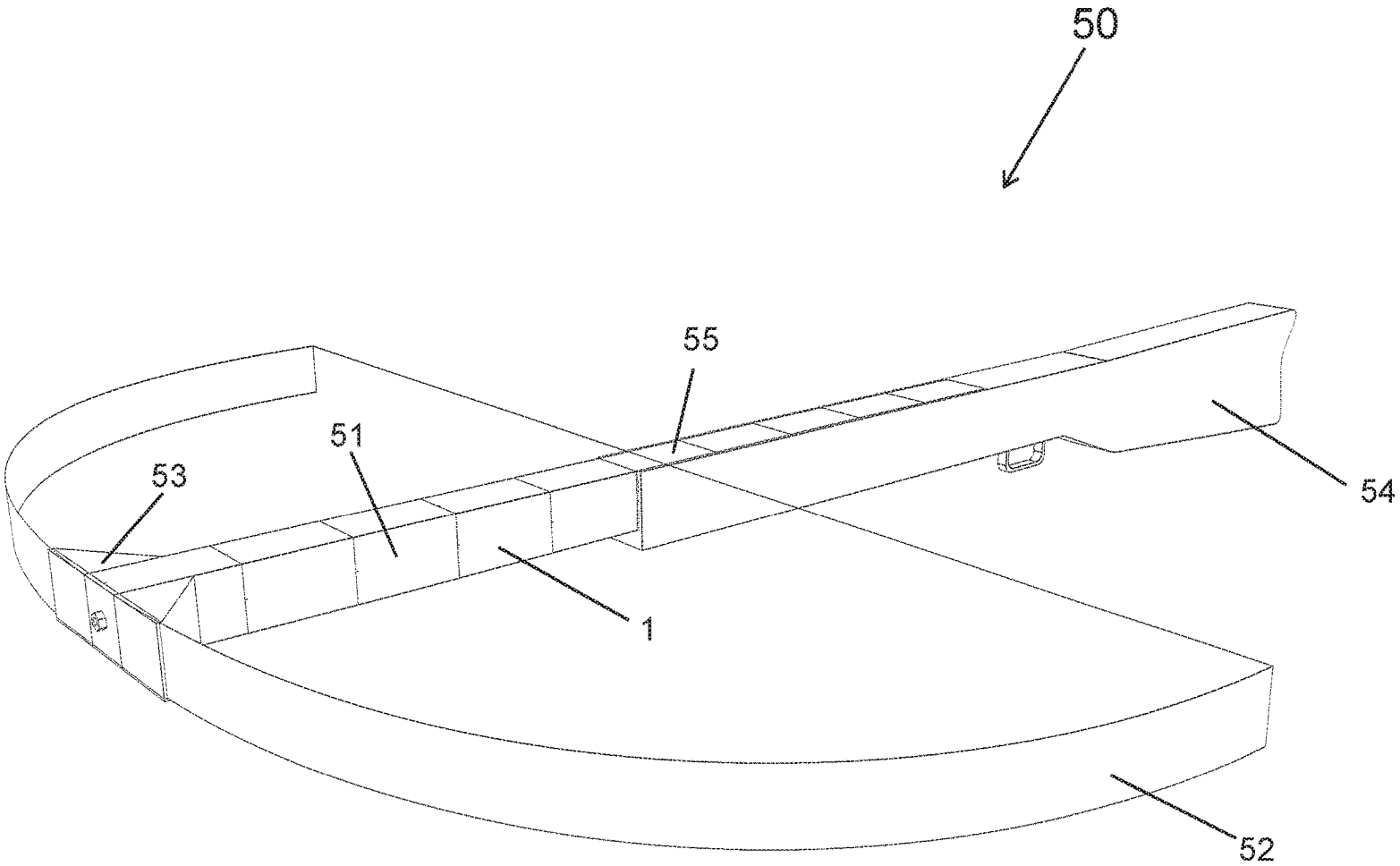
FIG. 19 is a perspective view of a preferred embodiment of a cross-bow utilizing a preferred embodiment of a columnar structure.

A high strength, low density columnar structure 1 is disclosed. Columnar structure 1 is made up of a plurality of stackable modules 3. Each module 3 preferably comprises three or four rectangular sides 4 extending between two opposite faces 5, 6. The resulting module 3 is either a cuboid 7 or a prism 8. Each adjacent pair of sides 4 meets at a corner 9 that extends from one face 5, 6 to the other. In the prismatic embodiment 8, there will be three corners 9, whereas in the cuboid version 7, there will be four corners 9. Each corner 9 has a midpoint 10.

The upper and lower ends 11, 12 of each side 4 define the border 13 of each face 5, 6. Each end 11, 12 has a midpoint 30 and a width 14 defined by an outer edge 15 and an inner edge 16. Together the outer edges 15 of each end 11, 12 define an outer perimeter 17 of each face 5, 6 while the inner edges 16 define an inner perimeter 18 of each face 5, 6.

A lip 19 extends from each side 4 at lower end 12. Together lips 19 extend the length of inner perimeter 18, though it will be appreciated that lips 19 need not be continuous. That is, a lip 19 will preferably be positioned on at least two and preferably all sides 4. However, lip 19 need not extend in an unbroken line between adjacent corners 9.

Each module 3 is preferably provided with a brace 21. Brace 21 preferably comprises a panel 22 extending from each interior face 20 of each side 4 proximate upper end 11. Panel 22 is preferably a rectilinear shape comprising a plurality of panel corners 23. Most preferably panel 22 is a rectangle or square when module 3 is a cuboid 7 and a triangle when module 3 is a prism 8. Each panel corner 23 preferably joins interior face 20 of each side 4 proximate midpoint 30 of upper end 11. In the preferred embodiment, this will position one module corner 9 between each adjacent pair of panel corners 23.

A panel edge 24 extends between each panel corner 23. Together, panel edges 24 and panel corners 23 define a perimeter 25 of panel 22. A brace arm 26 extends from each panel edge 24 to the module corner 9 positioned between each pair of adjacent panel corners 23. Brace arm 26 preferably extends to a point on module corner 9 proximate lower end 12.

Brace arm 26 is preferably triangular in shape. The base 28 of the triangle, opposite distal end 27 depends from a panel edge 24. The other two borders 29 of triangular brace arm 26 extend along sides 4 of module 3.

Panel 22 is preferably integral with sides 4 of module 3 at panel corners 23. Brace arm 26 is also preferably integral with sides 4 along the length of borders 29. Brace arm 26 is also preferably integral with module corner 9 at distal end 27 of brace arm 26. It will be appreciated that compressive loads applied to module 3 generally perpendicularly to faces 5, 6 will be transferred to sides 4 by brace 21 and brace arm(s) 26. Likewise, forces transverse to sides 4 will be resisted by brace 21 and brace arm(s) 26.

Panel 22 and brace arms 26 serve as a buttress. They redistribute compressive loads on module 3 down and out, while simultaneously preventing deformation of sides 4.

At least one aperture 31 is preferably provided in panel 22. Aperture 31 will most preferably be positioned in the center of panel 22. Panel 22 should preferably be positioned so that aperture 31 is positioned around an axis 32 generally parallel to module corners 9 and about equidistant from all corners 9.

Lip 19 facilitates vertical stacking of modules 3. Upper ends 11 of sides 4 may be provided with a recess 75 sized to receive lip 19. One module 3 may be placed atop another so that lip 19 of an upper module 3 fits within recess 75 of upper face 5 of a lower module 3. It will be appreciated that in this configuration, lower face 6 of an upper module 3 will be aligned with upper face 5 of a lower module 3. Significantly, upper ends 11 of sides 4 of the lower module 3 will be aligned and in contact with lower ends 12 of sides 4 of upper module 3. This will allow for the efficient transfer of compressive forces from upper module 3 to lower module 3 and vice versa. Once lip 19 of an upper module 3 is fully inserted into recess 75 of a lower module 3, upper and lower modules 3 will be aligned, rotation of modules 3 relative to one another will be inhibited, and ends 11, 12 will meet, resulting in the efficient transfer of a load between modules 3.

Recess 75 and lip 19 perform an important additional bracing function. Compressive loads on module 3 will be dispersed outwardly and down by brace arms 26. These forces will be distributed to sides 4 where brace arms 26 meet sides 4. However, they will also be applied to corners 9 proximate lower face 6 where distal ends 27 of brace arms 26 meet corners 9. The forces applied to corners 9 will tend to push the lower ends 12 of sides 4 outward. Such swelling of modules 3 would weaken and even potentially lead to the failure of modules 3.

Positioning lip 19 within recess 75 will resist the aforementioned swelling. Recess 75 will surround lip 19. Any outward motion of sides 4 would be imparted to lip 19. Recess 75 will impede any outward motion of lip 19. This strengthening effect may be enhanced as necessary by making the outer walls 76 of recess 75 thicker.

Once modules 3 are stacked into columnar structure 1, they may be secured to one another in a variety of ways. A threaded tube or bolt 33 may be passed through apertures 31 which, in the preferred embodiment, will be aligned when modules 3 are stacked. By utilizing conventional washers and nuts, modules 3 may be secured via compression. Modules 3 may be screwed, glued or welded to each other. Mortar may be used. Different options may be combined.

Modules 3 may be cast concrete; molded or milled plastic; milled or cast steel, aluminum, or other metals; graphite; printed plastic, resin, or metal powder; or any other conventional material. When 3D printing manufacturing technologies are utilized, the module designs disclosed herein are well suited for strategic infilling. The best methodology for securing modules 3 within columnar structure 1 will depend upon the materials from which modules 3 are made.

Alternatively, with 3D printing, columnar structures 1 may be printed as a single integral piece, rather than forming modules 3 and assembling them. Whether to assemble columnar structure 1 from modules 3 or to form it as an integral composite—or a plurality of integral composites—will depend upon the intended application.

It will be appreciated that the length of columnar structure 1 may be adjusted easily by adding or omitting modules 3 from columnar structure 1. Modules 3 may be made of varying heights in order to fine tune the length of columnar structure 1.

In one embodiment, modules 3 are provided with a hollow, preferably cylindrical column 80 positioned about axis 32. Column 80 will extend from upper face 5 to lower face 6. Upper end 81 of column 80 will comprise aperture 31. A collar 82 may be positioned on panel 22. Collar 82 will be aligned with aperture 31 and will be sized to receive lower end 83 of column 80. Lower end 83 and lip 19 will preferably be coplanar. Likewise, the interior of collar 82 will be horizontally aligned with the base of recess 75 such that lower end 83 of column 80 will be fully inserted into collar 82 simultaneously with the complete insertion of lip 19 into recess 75.

Collar 82 preferably has an inside diameter 84. Inside diameter 84 of collar 82 will preferably be slightly larger than outside diameter 85 of lower end 83 of column 80. This will allow lower end 83 of column 80 of an upper module 3 to fit within collar 82 when two modules are stacked vertically. The fit will preferably be snug.

Collar 82 will also position and maintain lower end 83 of column 80 in an upper module 3 adjacent to upper end 81 of column 80 in a lower module 3. This will place the columns in mechanical communication. In the preferred embodiment, mechanical communication is achieved via direct physical contact between columns 80; however, spacers or other conventional load bearing connection devices could be utilized. The desired mechanical communication will facilitate transfer of vertical loads from one column 80 to the column 80 above or below it.

As should be appreciated from the foregoing discussion, columns 80 will extend through columnar structure 1, facilitating the support and distribution of compressive loads across structure 1. Columns 80 should be mechanically connected to permit the aforementioned load transfer. Columns 80 may be directly connected to one another, the lower end 83 of each columns 80 may rest on panel 22, the lower end 83 of column 80 may rest in collar 82, or other conventional mechanical connections may be utilized.

In one embodiment, module 3 is provided with a plurality of struts 86. Struts 86 will preferably extend radially from column 80, either to corners 9 or sides 4 or both. Struts 86 will preferably extend from upper face 5 to lower face 6. Proximate to lower face 6 and column 80, struts 86 may be provided with a notch 89. It will be appreciated that notches 89 will facilitate insertion of lower end 83 of column 80 into collar 82 of an adjacent module 3.

In cuboid embodiment 7, a first set of four struts 86 is disposed about column 80. Struts 86 are arranged about 90 degrees apart. In one embodiment, this will position each strut 86 in a corner 9. In another embodiment, another set of four struts 86 is provided. These are also disposed radially about column 80, but they will extend from column 80 to sides 4. In a preferred embodiment, each of the second set of struts 86 are offset by about 45 degrees relative to corners 9. In yet another embodiment, both sets of struts 86 are provided, one set extending to corners 9 and the second set extending to sides 4, each set offset relative to the other by about 45 degrees.

In prismatic embodiment 8, struts 86 may likewise be provided in sets, preferably sets of three. A first set of three struts 86 is radially disposed about column 80. Struts 86 are preferably arranged about 120 degrees apart. In one embodiment, this will position each strut 86 in a corner 9. In another embodiment, another set of three struts 86 is provided. These are also disposed radially about column 80, but they will extend from column 80 to sides 4. In yet another embodiment, both sets of struts 86 are provided, one set extending to corners 9 and the second set extending to sides 4, each set offset relative to the other by about 60 degrees.

It will be appreciated that in prismatic embodiment 8, when two sets of three struts 86 are utilized, struts 86 are offset to each other by about 120 degrees; the sets are offset relative to each other by about 60 degrees; and each individual strut 86 will be offset relative to its neighbor by about 60 degrees. As a result, when a first strut 86 extends to a corner 9, the third following strut 86—the second strut 86 on the offset set—will be oriented 180 degrees to the first strut 86. This will result in pairs of aligned struts 86, one extending from column 80 to corner 9 and another extending from column 80 to side 4 opposite the first corner 9. Together the two struts 86 effectively extend from corner 9 to the opposite side 4, through column 80.

In cuboid embodiment 7, struts 86 will be arranged in similar paired relationship. One strut 86 will extend from column 80 to a corner 9. Another strut 86 will extend from column 80 to the opposite corner 9. Together, the two struts 86 will extend diagonally across module 3, from corner 9 to corner 9, and will be joined by column 80. Similar opposing pairs of struts 86 exist in the other set of struts 86 extending from one side 4 to the opposite side 4 through column 80.

It will be appreciated that when struts 86 extend to any corner 9, strut 86 will intersect with brace arm 26. In the preferred embodiment, the intersection will be substantially seamless. Strut 86 and brace arm 26 will reinforce one another.

Struts 86 are preferably positioned so that struts 86 of an upper module 3 align with struts 86 of a lower module 3 when modules 3 are arranged in columnar structure 1. Struts 86 are preferably sized so that upper end 90 of each strut 86 in a lower module 3 will contact lower end 91 of a corresponding strut 86 in an upper module 3 when modules 3 are assembled into columnar structure 1. This will facilitate transfer of compressive loads between upper and lower modules 3.

Struts 86 provide additional compressive strength to modules 3 and columnar structures 1. However, struts 86 will also significantly stiffen columnar structure 1, resisting forces that are transverse to axis 32 as well as torsional forces applied to columnar structure 1. Struts 86 will also reinforce brace 21 and vice versa.

It will be appreciated that there are four basic embodiments of modules 3 in order of increasing strength: no column 80; column 80; column 80 plus one set of struts 86; and column 80 plus two sets of struts. 86. Although not shown, column 80 could be omitted while retaining struts 86. In this instance, struts 86 would simply intersect at about central axis 32 instead of meeting at column 80. Different combinations of the foregoing embodiments could be used, as desired and needed either across different columnar structures 1 or within a single columnar structure 1.

In one embodiment, columnar structure 1 is provided with a pair of caps 34, 35. Upper cap 34 is configured to mate with upper face 5 while lower cap 35 will be configured to mate with lower face 6. Caps 34, 35 may be provided with apertures 36 positioned to align with apertures 31 in modules 3 within columnar structure 1. Caps 34, 35 may serve as nuts by providing one or both apertures 36 with internal threads. By providing one end of bolt 33 with an oversized head and/or a washer and threading the other end through aperture 36, modules 3 may be bolted together.

In one embodiment, columnar structure 1 may be provided with a housing 87. Housing 87 may be a hollow cylinder 88 sized to contain columnar structure 1. Preferably, cylinder 88 is sized to engage corners 9. Columnar structure 1 and housing 87 will reinforce each other. Columnar structure 1 will provide transverse bracing to housing 87 and housing 87 and columnar structure 1 will augment the compressive strength of each component.

In another embodiment, housing 87 may be a shell tailored to the shape of columnar structure 1 and the modules 3 which form it. In this embodiment, housing 87 will help secure the engagement of modules 3 and reinforce columnar structure 1.

Modules 3 will be substantially void. Depending upon which embodiment of modules 3 is utilized, modules may be from about 76 percent void (no column 80 and no struts 86) to about 66 percent void (column 80 and two sets of struts 86). The majority of modules 3 is open space in any of the embodiments, but the ability of modules to withstand compressive, transverse, and torsional loads is quite high. Of course, the actual open space will depend upon the dimensions of module 3 and the thickness of sides 4 and especially of column 80, brace arms 26, and struts 86.

Once modules 3 have been assembled into a columnar structure 1, columnar structure 1 may be used in a host of applications—with or without housing 87. Multiple columnar structures may be positioned adjacent to one another to form a wall 101. Any application that requires high compressive strength while minimizing weight is ideal. Examples, include architectural support columns, bulkheads or bulkhead reinforcements in watercraft or especially aircraft or space craft; oil derrick support legs, and automotive chassis frames and rails.

One application for which columnar structure 1 is particularly suited is as the barrel 51 of crossbow 50. In a crossbow, the limbs 52 are mounted to risers 53. Risers 53 are mounted to the barrel 51. The barrel 51 extends from risers 53 to the stock 54. When limbs 52 are in a loaded or cocked position, the bowstring will be held in the cocked position by a latch 55. The force between the limbs 52 and the latch 55 will exert a significant compressive force on the barrel 51, which is located between latch 55 and risers 53. Then, when crossbow 50 is fired, limbs 52 will unload a substantial force onto the bolt (not shown). An opposite force will be transmitted to barrel 51 and stock 54. In prior art crossbows, the barrel and stock are generally solid wood, aluminum, or carbon fiber. The former are heavy. The latter is expensive. Utilizing columnar structure 1 as the barrel 51 and/or stock 54 will significantly strengthen crossbow 50, while allowing the weight of cross bow 50 to be reduced substantially. It will be appreciated that columnar structure 1 may be the barrel 51 or stock 54 or columnar structure 1 may be a reinforcing component contained within barrel 51 or stock 54.

The advantages of columnar structure 1 in a crossbow application are particularly apparent when the strength and weight of columnar structure 1 are considered. For example, modern crossbows 50 with a typical draw weight of 800 lbs commonly weigh between 5 and 10 lbs. The barrel and the stock are typically the heaviest components. Computer models of a columnar structure 1 made of aluminum suggest a failure load of about 3000 lbs for a columnar structure 1 weighing 0.75 pounds. Even assuming the failure load was optimistic by 50 percent, a 1500 lb failure load for devices intended to support an 800 lb load would be more than adequate. Supporting such loads with ¾ of a pound of aluminum would achieve a significant weight savings. By using columnar structure 1 as barrel 51, stock 54 or both, either alone or as support for a lightweight skin, the overall weight of crossbow 50 could be reduced significantly-potentially below 3 lbs—while performance is increased.

These and other improvements will be apparent to those of skill in the art from the foregoing disclosure and drawings and are intended to be encompassed by the scope and spirit of the following claims.

I claim:

1. A method of forming a high strength, low density columnar structure from a plurality of modules, wherein each said module within the plurality of modules has a shape selected from the group consisting of prisms and cuboids;

wherein each module within the plurality of modules further comprises a plurality of substantially rectangular sides, wherein each side of the plurality of substantially rectangular sides is configured to intersect with two other sides of the plurality of substantially rectangular sides at an intersection, wherein each intersection forms a module corner extending between an upper face and a lower face of said module, said plurality of substantially rectangular sides, said module corners, and said upper and lower faces defining said shape of said module; and a brace comprising a brace panel positioned proximate to said upper face and a plurality of brace arms, each said brace arm extending from said brace panel to one of said module corners;

wherein the brace panel of each of said plurality of modules further comprises a brace panel aperture positioned in approximately a center of each said brace panel;

wherein each of said modules within the plurality of modules further comprises a substantially hollow column extending from said brace panel aperture to a lower end of said column positioned proximate said lower face;

wherein the method comprises stacking said plurality of modules vertically to form said columnar structure;

wherein the brace panel aperture of each of the modules within said plurality of modules together comprise a plurality of brace panel apertures when said plurality of modules are stacked vertically;

wherein the substantially hollow column of each of the modules within said plurality of modules together comprise a plurality of substantially hollow columns when said plurality of modules are stacked vertically;

wherein the plurality of brace panel apertures are substantially aligned when said plurality of modules are stacked vertically to form said columnar structure; and wherein said plurality of substantially hollow columns are substantially aligned, and wherein each substantially hollow column within the plurality of substantially hollow columns is in mechanical communication with at least one other substantially hollow column within said plurality of substantially hollow columns, when said plurality of modules are stacked vertically to form said columnar structure, whereby said plurality of substantially hollow columns are configured to transmit compressive forces through said columnar structure.

2. The method of forming a high strength, low density columnar structure according to claim 1 wherein said plurality of substantially hollow columns are substantially cylindrical.

3. The method of forming a high strength, low density columnar structure according to claim 1 wherein each said module further comprises a plurality of struts extending radially from the substantially hollow column within each module within said plurality of modules.

4. The method of forming a high strength, low density columnar structure according to claim 3 wherein said plurality of struts within each module in said plurality of modules extend from said upper face to said lower face of said module.

5. The method of forming a high strength, low density columnar structure according to claim 4 wherein said plurality of struts within each module in said plurality of modules are configured to align with the struts of at least one adjacent module in said plurality of modules when said modules are stacked to form said columnar structure.

6. The method of forming a high strength, low density columnar structure according to claim 5 wherein said plurality of struts within each module within said plurality of modules are in mechanical communication with the struts of at least one adjacent module in said plurality of modules when said modules are stacked to form said columnar structure, whereby said struts are configured to transmit compressive forces through said columnar structure.

7. The method of forming a high strength, low density columnar structure according to claim 6 wherein at least one of said plurality of struts in each module within said plurality of modules extends from said substantially hollow column in each module within said plurality of modules to at least one of the module corners.

8. The method of forming a high strength, low density columnar structure according to claim 7 wherein at least one of said plurality of struts in each module within said plurality of modules extends from said substantially hollow column in each module within said plurality of modules to at least one of said plurality of substantially rectangular sides of said module.

9. The method of forming a high strength, low density columnar structure according to claim 1 further comprising securing said modules within said plurality of modules to one another with a bolt running through said brace panel apertures.

10. The method of forming a high strength, low density columnar structure according to claim 1 further comprising securing said modules within said plurality of modules to one another with an adhesive.

11. The method of forming a high strength, low density columnar structure according to claim 1 wherein said plurality of modules are stacked so that the upper face of each module within said plurality of modules is adjacent the lower face of an adjacent module.

12. The method of forming a high strength, low density columnar structure according to claim 11 wherein each module within said plurality of modules further comprises a lip extending from the lower surface of said module.

13. The method of forming a high strength, low density columnar structure according to claim 12 wherein said upper surface of each said module within said plurality of modules is configured to receive said lip from an adjacent module when said modules are stacked to form said columnar structure.

14. A method of forming a high strength, low density columnar structure from a plurality of modules, wherein each said module within said plurality of modules has a shape selected from the group consisting of prisms and cuboids;

wherein each module within the plurality of modules further comprises a plurality of substantially rectangular sides, wherein each side of the plurality of substantially rectangular sides is configured to intersect with two other sides of the plurality of substantially rectangular sides at an intersection, wherein each intersection forms a module corner extending between an upper face and a lower face of said module, said plurality of substantially rectangular sides, said module corners, and said upper and lower faces defining said shape of said module; and a brace comprising a brace panel positioned proximate to said upper face and a plurality of brace arms, each said brace arm extending from said brace panel to one of said module corners;

wherein the brace panel of each of said plurality of modules further comprises a brace panel aperture positioned in approximately a center of each said brace panel;

wherein each of said modules within said plurality of modules further comprises a substantially hollow column extending from said brace panel aperture to a lower end of said substantially hollow column positioned proximate said lower face;

wherein each said module within said plurality of modules further comprises a plurality of struts extending radially from the substantially hollow column within each module of the plurality of modules;

wherein the method comprises stacking said plurality of modules vertically to form said substantially hollow columnar structure;

wherein the brace panel aperture of each of the modules within said plurality of modules together comprise a plurality of brace panel apertures when said plurality of modules are stacked vertically; wherein the substantially hollow column of each of the modules within said plurality of modules together comprise a plurality of substantially hollow columns when said plurality of modules are stacked vertically; wherein the plurality of brace panel apertures are substantially aligned when said plurality of modules are stacked vertically; and wherein said plurality of substantially hollow columns are substantially aligned when said plurality of modules are stacked vertically.

15. The method of forming a high strength, low density columnar structure according to claim 14 wherein said plurality of struts within each module within said plurality of modules extend from said upper face to said lower face of said module.

16. The method of forming a high strength, low density columnar structure according to claim 15 wherein said plurality of struts within each module within said plurality of modules are configured to align with the struts of at least one adjacent module in said plurality of modules when said modules are stacked to form said columnar structure.

17. The method of forming a high strength, low density columnar structure according to claim 16 wherein said plurality of struts within each module within said plurality of modules are in mechanical communication with the struts of at least one adjacent module in said plurality of modules when said modules are stacked to form said columnar structure, whereby said struts are configured to will transmit compressive forces through said columnar structure.

18. The method of forming a high strength, low density columnar structure according to claim 17 wherein at least one of said plurality of struts in each module within said plurality of modules extends from said substantially hollow column in each module to at least one of the module corners.

19. The method of forming a high strength, low density columnar structure according to claim 18 wherein at least one of said plurality of struts in each module within said plurality of modules extends from said substantially hollow column in each module within said plurality of modules to at least one of said plurality of substantially rectangular sides of said module.

20. The method of forming a high strength, low density columnar structure according to claim 14 further comprising securing said modules within said plurality of modules to one another with a bolt running through said brace panel apertures.

21. The method of forming a high strength, low density columnar structure according to claim 14 further comprising securing said modules within said plurality of modules to one another with an adhesive.

* * * * *